US011145978B2

(12) United States Patent
Zimmerman et al.

(10) Patent No.: US 11,145,978 B2
(45) Date of Patent: Oct. 12, 2021

(54) PHASED ARRAY ANTENNAS HAVING MULTI-LEVEL PHASE SHIFTERS

(71) Applicant: CommScope Technologies LLC, Hickory, NC (US)

(72) Inventors: Martin Lee Zimmerman, Chicago, IL (US); Jonathon C. Veihl, New Lenox, IL (US); Xiaohua Hou, Richardson, TX (US); Zhonghao Hu, Bella Vista (AU); Himath Priyananda, Epping (AU)

(73) Assignee: CommScope Technologies LLC, Hickory, NC (US)

( * ) Notice: Subject to any disclaimer, the term of this patent is extended or adjusted under 35 U.S.C. 154(b) by 270 days.

(21) Appl. No.: 16/301,369

(22) PCT Filed: Jun. 12, 2017

(86) PCT No.: PCT/US2017/036984

§ 371 (c)(1),
(2) Date: Nov. 13, 2018

(87) PCT Pub. No.: WO2017/218396

PCT Pub. Date: Dec. 21, 2017

(65) Prior Publication Data

US 2020/0321697 A1 Oct. 8, 2020

Related U.S. Application Data

(60) Provisional application No. 62/400,433, filed on Sep. 27, 2016, provisional application No. 62/351,317, filed on Jun. 17, 2016.

(51) Int. Cl.
*H01Q 3/30* (2006.01)
*H01Q 3/32* (2006.01)
(Continued)

(52) U.S. Cl.
CPC ..... *H01Q 3/32* (2013.01); *H01P 1/184* (2013.01); *H01Q 1/246* (2013.01); *H01Q 5/48* (2015.01)

(58) Field of Classification Search
CPC .. H01Q 3/30; H01Q 3/32; H01Q 5/48; H01Q 1/246; H01Q 1/24; H01Q 21/26; H01P 1/184
See application file for complete search history.

(56) References Cited

U.S. PATENT DOCUMENTS 7,463,190 B2 12/2008 Zimmerman
8,674,787 B2 3/2014 Bradley et al.
(Continued)

FOREIGN PATENT DOCUMENTS

CN 2514507 10/2002
CN 101615721 A 12/2009
(Continued)

OTHER PUBLICATIONS

International Search Report and Written Opinion of the International Searching Authority, International Application No. PCT/US2017/036984, dated Oct. 24, 2017, 12 pp.
(Continued)

*Primary Examiner* — Awat M Salih
(74) *Attorney, Agent, or Firm* — Myers Bigel, P.A.

(57) ABSTRACT

A phased array antenna includes a panel, a plurality of feed boards on the panel, each of the feed boards including at least one radiating element, a base-level adjustable phase shifter including a plurality of outputs, a first feed board adjustable phase shifter mounted on a first of the feed boards and a first cable that forms a transmission path between a first of the outputs of the base-level adjustable phase shifter and the first feed board.

20 Claims, 18 Drawing Sheets

(51) Int. Cl.

| | |
|---|---|
| ***H01Q 5/48*** | (2015.01) |
| ***H01P 1/18*** | (2006.01) |
| ***H01Q 1/24*** | (2006.01) |

(56) References Cited

U.S. PATENT DOCUMENTS

| | | | | |
|---|---|---|---|---|
| 8,674,788 | B2 | 3/2014 | Le | |
| 10,116,425 | B2 | 10/2018 | Zimmerman | |
| 2004/0085250 | A1 | 5/2004 | Tillery | |
| 2005/0248494 | A1 | 11/2005 | Davies | |
| 2008/0024385 | A1 | 1/2008 | Zimmerman | |
| 2008/0079640 | A1 | 4/2008 | Yang | |
| 2013/0120206 | A1 | 5/2013 | Biancotto et al. | |
| 2015/0098495 | A1 | 4/2015 | He et al. | |
| 2015/0200467 | A1* | 7/2015 | Kurk | H01Q 5/50 343/853 |

FOREIGN PATENT DOCUMENTS

| | | | |
|---|---|---|---|
| CN | 102683897 | A | 9/2012 |
| CN | 102907168 | A | 1/2013 |
| CN | 103975485 | | 8/2014 |
| EP | 1178563 | A1 | 2/2002 |
| EP | 2221924 | A2 | 8/2010 |
| JP | 2011109181 | | 6/2011 |
| WO | 2017036339 | A1 | 3/2017 |

OTHER PUBLICATIONS

English translation only of Chinese Office Action, for Chinese Application No. 201780037038.8, dated Jun. 23, 2020, 10 pgs.

Shaohua, Chan "Design of Novel Base Station Antenna Phase Shifter and Ultra-wideband Bow-tie Antenna" Jiangsu University, Master's Dissertation, 83 pages (2013) (English translation of abstract).

* cited by examiner

PHASED ARRAY ANTENNAS HAVING MULTI-LEVEL PHASE SHIFTERS

CROSS-REFERENCE TO RELATED APPLICATIONS

The present application is a 35 U.S.C. § 371 national stage application of PCT Application No. PCT/US2017/036984, filed on Jun. 12, 2017, which itself claims priority under 35 U.S.C. § 119 to U.S. Provisional Patent Application Ser. No. 62/351,317, filed Jun. 17, 2016, and to U.S. Provisional Patent Application Ser. No. 62/400,433, filed Sep. 27, 2016, the entire content of each of which is incorporated herein by reference. The above referenced PCT Application was published in the English language as International Publication No. WO 2017/218396 A1 on Dec. 21, 2017.

FIELD

The present invention relates to wireless communications and, more particularly, to phased array antennas suitable for use in cellular base stations.

BACKGROUND

Base station antennas for wireless base stations typically comprise one or more arrays of radiating elements such as dipoles that are mounted on, for example, a flat panel. Each array of radiating elements may produce an antenna beam that has desired characteristics such as, for example, a desired beam elevation angle, beam azimuth angle, and/or half power beam width. A signal that is to be transmitted by such a base station antenna is divided into multiple sub-components, and each sub-component may be fed through an antenna feed network to a respective one of the radiating elements.

Cellular operators are constantly looking for ways to increase network throughput to accommodate ever increasing subscriber traffic levels. Based on network coverage requirements, operators may find it advantageous to adjust the vertical elevation angle (i.e., the vertical angle of the antenna with respect to the horizon) or "tilt" of the main beam of a base station antenna in order to change the coverage area of the antenna. Such adjustment is typically referred to as "down-tilting" as the antenna is almost always tilted to point at an elevation angle of 0° or less with respect to the horizon such as, for example, an elevation angle of 0° to −10°, although down-tilts as large as 30° or more are used in some applications.

The tilt of a base station antenna may be adjusted mechanically and/or electrically. Mechanical tilt is implemented by physically adjusting the elevation angle of the antenna, either manually or by remote control of a motorized structure. Manual mechanical adjustment typically requires that a technician climb an antenna tower to physically adjust the tilt of the antenna, which can be expensive in practice. Remotely controlled mechanical adjustment avoids the tower climbs, but requires additional and/or more complex structures on the antenna tower such as motorized antenna mounts that are more expensive, increase the weight at the top of the tower, and/or result in more items of equipment that can potentially fail. Moreover, mechanically down-tilting an antenna causes the radiation that is emitted backwardly from the antenna (i.e., toward the flat panel) to be tilted upwardly, which is undesirable for several reasons. Thus, mechanical down-tilting of an antenna may be less than ideal in many applications.

A phased array antenna may be electrically down-tilted by controlling the phases of the sub-components of a signal that are transmitted through each radiating element of the array in a manner that changes the elevation angle of the main antenna beam. Such electrical down-tilt is typically performed by transmitting a control signal from a remote location to the base station antenna. In response to this control signal, the base station antenna adjusts settings of phase shifters that are included in the antenna feed network to implement the phase shifts. Such electrically controlled down-tilting of the antenna is often referred to as "remote electronic tilt." Electrical down-tilting of a phased array antenna typically adjusts the radiation pattern of the antenna downwardly in all directions, and hence, electrical down-tilting is typically preferred over mechanical down-tilting as it provides a more desirable adjustment to the radiation pattern of the antenna. Network performance may be improved if the tilt of the base station antennas are adjusted to optimize the coverage patterns of the antenna. For example, a phased array antenna may be electrically down-tilted to correct for movement of the antenna that has occurred over time or to reduce the coverage area of the antenna as new cellular base stations are installed to provide increased cell density.

Electromechanical phase shifters are typically used to electronically down-tilt the radiation pattern of a phased array antenna. These phase shifters are typically integrated within the antenna according to one of two conventional approaches, namely in monolithic and non-monolithic implementations. In the monolithic implementation, a "centralized" phase shifter and each of the radiating elements of an array are mounted on a single printed circuit board. Typically, the radiating elements are mounted on the front side of the printed circuit board, and the phase shifter is mounted in a central location on the back side of the printed circuit board. Transmission lines are provided on the printed circuit board that connect each output of the centralized phase shifter to a respective one of the radiating elements. In some cases, the number of radiating elements may exceed the number of outputs on the phase shifter. In such cases, power dividers may be provided along the transmission lines that further sub-divide the signals, and additional transmission lines are provided that extend from each output of the power dividers to the respective radiating elements so that each output of the centralized phase shifter is connected to one or more of the radiating elements via the transmission lines and power dividers.

In the non-monolithic implementations, the phase shifters are implemented separately from the radiating elements. Two different non-monolithic implementations are commonly used. In the first non-monolithic implementation, a centralized phase shifter is provided that has outputs that connect to a corporate feed network. The centralized phase shifter typically has an input, a relatively large number (e.g., five, seven or nine) outputs, and a corresponding number of paths that extend between the input and the respective outputs. The centralized phase shifter may apply a different phase adjustment to each of these paths. For example, a five output phase shifter might decrease the phase delay at first and second outputs thereof by 2X° and X°, increase the phase delay at fourth and fifth outputs thereof by X° and 2X° and not adjust the phase delay at the third output thereof. Each of the five outputs of this example phase shifter would then be connected to a respective one of the radiating elements or to a respective sub-group of radiating elements. The above-described centralized phase shifters thus employ a parallel or "one-to-many" design in which different phase shifts are applied to each of a plurality of parallel paths. A wiper arc phase shifter such as the phase shifter disclosed in U.S. Pat. No. 7,463,190, the contents of which is incorporated herein by reference, is one example of a phase shifter that may be used to implement the above-described centralized phase shifter in the first non-monolithic implementation.

The second non-monolithic approach employs a serial-output phase shifter. A typical serial-output phase shifter is implemented using a plurality of directional couplers or power dividers and phase shifters. The directional couplers and phase shifters are arranged in series in alternating fashion, with the output of each phase shifter coupled to the input of the downstream directional coupler in the series. A first output of each directional coupler is connected to the input of the next downstream phase shifter in the series, and the second output of each directional coupler is connected to a respective one of the radiating elements. The phase shift applied to the signal coupled to each radiating element is the sum of the individual phase shifts applied by each of the phase shifters that are upstream of a particular radiating element.

SUMMARY

Pursuant to embodiments of the present invention, a phased array antenna is provided that includes a panel, a plurality of feed boards on the panel, each of the feed boards including at least one radiating element, a base-level adjustable phase shifter including a plurality of outputs, a first feed board adjustable phase shifter mounted on a first of the feed boards and a first cable that forms a transmission path between a first of the outputs of the base-level adjustable phase shifter and the first feed board.

In some embodiments, the phased array antenna may further include a second feed board adjustable phase shifter mounted on a second of the feed boards and a second cable that forms a transmission path between a second of the outputs of the base-level adjustable phase shifter and the second feed board. The first and second of the feed boards may include the same numbers of radiating elements and/or have the same design in some embodiments. The base-level adjustable phase shifter may be mounted on a third of the feed boards, and the third of the feed boards includes a third feed board adjustable phase shifter and a plurality of additional radiating elements in some embodiments.

In some embodiments, a first end of the first cable may be coupled to the first of the output of the base-level adjustable phase shifter via a first radio frequency (RF) junction and a second end of the first cable may be coupled to an input of the first feed board adjustable phase shifter via a second RF junction.

In some embodiments, the first and second RF junctions may comprise first and second solder joints, respectively.

In some embodiments, the first and second RF junctions may comprise first and second capacitive connections, respectively.

In some embodiments, the first of the feed boards may include a plurality of radiating elements, the first feed board adjustable phase shifter may have a plurality of outputs, and each output of the first feed board adjustable phase shifter may be coupled to a respective at least one of the radiating elements on the first of the feed boards.

In some embodiments, the first feed board adjustable phase shifter may have three outputs, and each output of the first feed board adjustable phase shifter may be coupled to a single respective one of the radiating elements.

In some embodiments, the first feed board adjustable phase shifter may have three outputs, and at least one of the outputs of the first feed board adjustable phase shifter may be coupled to at least two of the radiating elements.

In some embodiments, the first cable may be coupled to an input of the first feed board adjustable phase shifter, and respective printed circuit board transmission lines may connect each output of the first feed board adjustable phase shifter to a respective at least one of the radiating elements.

In some embodiments, the first feed board adjustable phase shifter may be a trombone-style phase shifter.

In some embodiments, the first of the feed boards may include at least one power divider that unequally divides the power of an RF signal that is input to the first of the feed boards from the first cable.

In some embodiments, the first feed board adjustable phase shifter may include a main feed board, a wiper board that is mounted above the main feed board, and/or a biasing element that is mounted on the main feed board, the biasing element configured to apply a force onto an upper surface of the wiper board in order to bias the wiper board toward the main feed board.

In some embodiments, the first feed board adjustable phase shifter may include a main feed board, a wiper board that is mounted above the main feed board, and a multi-piece support that includes a first portion that is mounted on a first side of the panel and a second portion that is mounted on a second side of the panel that is opposite the first side, the support extending through a slot in the panel. In such embodiments, the wiper board may be mounted on the multi-piece support.

Pursuant to further embodiments of the present invention, a phased array antenna is provided that includes a first feed board, a plurality of radiating elements, a first subset of the radiating elements mounted on the first feed board, a base-level adjustable phase shifter that has an input and a plurality of outputs, and a first feed board adjustable phase shifter mounted on the first feed board. The first feed board adjustable phase shifter has an input that is coupled to a first of the outputs of the base-level adjustable phase shifter, and a plurality of outputs. Each output of the first feed board adjustable phase shifter is connected to a respective one or more of the radiating elements in the first subset of the radiating elements.

In some embodiments, the phased array antenna further includes a second feed board adjustable phase shifter mounted on a second feed board, the second feed board adjustable phase shifter having an input that is coupled to a second of the outputs of the base-level adjustable phase shifter, and a plurality of outputs. Each output of the second feed board adjustable phase shifter may be connected to a respective one or more of the radiating elements included in a second subset of the radiating elements that are mounted on the second feed board.

In some embodiments, the phased array antenna may further include a first cable that is coupled between the first of the outputs of the base-level adjustable phase shifter and the first feed board adjustable phase shifter and a second cable that is coupled between the second of the outputs of the base-level adjustable phase shifter and the second feed board adjustable phase shifter.

In some embodiments, the base-level adjustable phase shifter may be mounted on the first feed board, and the phased array antenna may further include a first cable that is coupled between the second of the outputs of the base-level adjustable phase shifter and the second feed board adjustable phase shifter.

In some embodiments, at least one of the outputs of the first feed board adjustable phase shifter may be coupled to at least two of the radiating elements in the first subset of the radiating elements.

In some embodiments, the base-level adjustable phase shifter and the first feed board adjustable phase shifter may comprise two of a plurality of adjustable phase shifters included as part of the phased array antenna, and no more than two of the adjustable phase shifters are on the RF transmission path between an input to the phased array antenna and any of the radiating elements.

In some embodiments, all of the radiating elements that are coupled to the base-level adjustable phase shifter may be configured to operate in the same frequency band.

In some embodiments, the first feed board adjustable phase shifter may be a trombone-style phase shifter.

In some embodiments, the first feed board may include at least one power divider that unequally divides the power of an RF signal that is input to the first feed board.

In some embodiments, the first feed board adjustable phase shifter may include a main feed board, a wiper board that is mounted above the main feed board, and a biasing element that is mounted on the main feed board, and the biasing element may be configured to apply a force onto an upper surface of the wiper board in order to bias the wiper board toward the main feed board.

In some embodiments, the first feed board adjustable phase shifter may include a main feed board, a wiper board that is mounted above the main feed board, and a multi-piece support that includes a first portion that is mounted on a first side of the panel and a second portion that is mounted on a second side of the panel that is opposite the first side, the support extending through a slot in the panel. In such embodiments, the wiper board may be mounted on the multi-piece support.

Pursuant to additional embodiments of the present invention, methods of transmitting a signal through a phased array antenna that has a plurality of radiating elements are provided in which the signal is coupled to a first base-level adjustable phase shifter that has a plurality of outputs, where phases of respective sub-components of the signal that are passed to each respective output of the base-level adjustable phase shifter are different. A first of the outputs of the first base-level adjustable phase shifter is coupled to an input of a first upper-level adjustable phase shifter that is mounted on a first feed board, the first upper-level adjustable phase shifter including a first subset of the radiating elements mounted thereon. At least two of the outputs of the first upper-level adjustable phase shifter are each connected to one or more of the radiating elements in the first subset of radiating elements by respective transmission lines on the first feed board.

In some embodiments, the method may further comprise coupling a second of the outputs of the first base-level adjustable phase shifter to an input of a second upper-level adjustable phase shifter that is mounted on a second feed board, the second upper-level adjustable phase shifter including a second subset of the radiating elements, where at least two of the outputs of the second upper-level adjustable phase shifter are each connected to one or more of the radiating elements in the second subset of radiating elements by respective transmission lines on the second feed board.

In some embodiments, the first and second feed boards may be part of a plurality of feed boards, and each output of the first base-level adjustable phase shifter may be connected by a respective one of a plurality of coaxial cables to a respective one of the plurality of feed boards. In such embodiments, the plurality of coaxial cables may be the only coaxial cables interposed on the RF transmission paths between an input to the first base-level adjustable phase shifter and the radiating elements.

Pursuant to further embodiments of the present invention, a feed board assembly is provided that includes a main feed board having an upper surface and a lower surface, a plurality of radiating elements mounted on the main feed board to extend upwardly from the upper surface of the main feed board, a wiper board mounted above the upper surface of the main feed board, the wiper board comprising part of an adjustable phase shifter and a wiper support that has a wiper board support portion that supports the wiper board, the wiper support extending through an opening in the main feed board.

In some embodiments, the wiper support may include a post that is received within a slot of a remote electronic downtilt mechanical linkage.

In some embodiments, the wiper support may connect to a remote electronic downtilt mechanical linkage underneath the lower surface of the main feed board.

In some embodiments, the wiper support may be a multi-piece wiper support, and at least two of the pieces of the wiper support clip together.

DETAILED DESCRIPTION

Each of the above described conventional approaches for implementing remote electronic tilt has certain drawbacks. Antennas implemented using the monolithic approach tend to be quite large and costly, as a monolithic design requires that the phase shifter and all of the radiating elements in the array be implemented on a single printed circuit board. State-of-the-art phased array antennas may include ten, twelve, sixteen or more radiating elements for some frequency bands, which are spread out across the panel, most typically in a linear array. In a monolithic approach, all of these radiating elements are mounted on the same printed circuit board, which is why the monolithic approach requires a large, more costly unit. This approach also tends to increase the overall weight of the antenna. Moreover, in order to reduce cost, relatively low cost printed circuit boards are typically used in base station antennas. Unfortunately, the transmission lines on such low cost printed circuit boards tend to exhibit relatively high insertion losses as compared to transmission lines that are implemented using coaxial cable segments. Relatively long transmission line segments may be used to connect the radiating elements at the ends of the array to the centralized phase shifter. Accordingly, the insertion losses may be relatively high. Because of the above short-comings, the monolithic approach is typically impractical on state-of-the-art flat panel phased array antennas for wireless base stations.

The non-monolithic approaches may allow for the use of smaller, lighter and/or lower loss components. However, the serial-output approach is typically not used because it requires a large number of separate phase shifters which may require an inordinate amount of space on the antenna and/or may be prohibitively expensive. The non-monolithic approach where a centralized phase shifter is incorporated into a corporate feed network is typically used today, but this approach tends to require a large number of solder joints that are used to connect the coaxial cables between the centralized phase shifter and respective feed boards on which the radiating elements are mounted. This will be explained in further detail with reference to FIGS. 1A-1B.

Figure 1A:
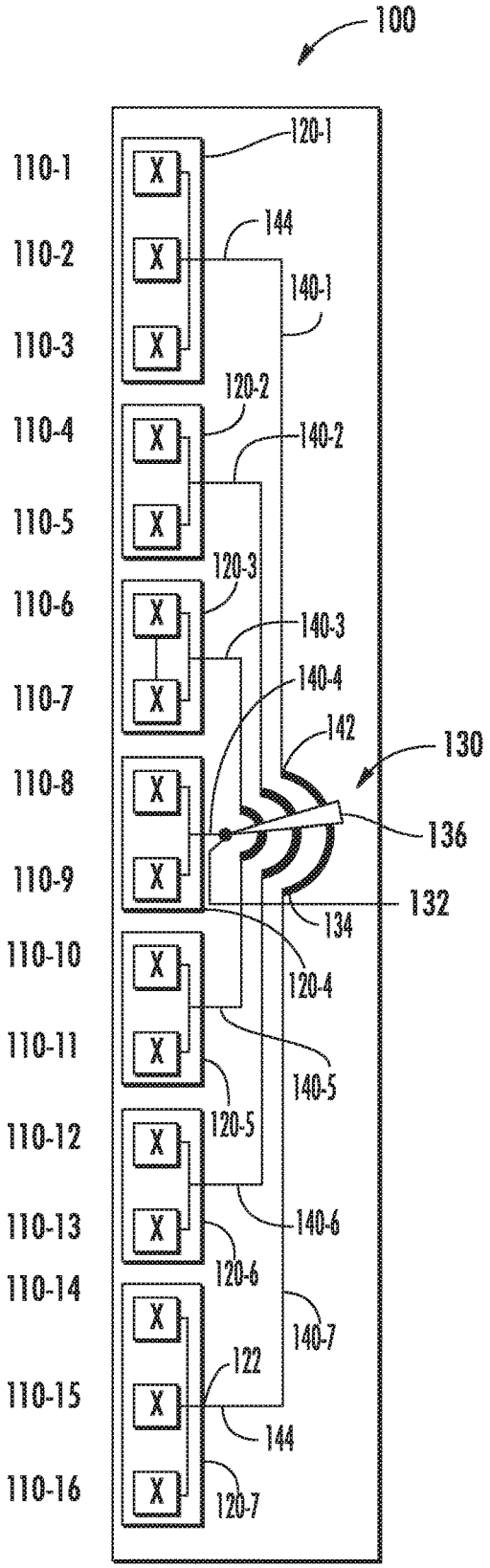
FIG. 1A PRIOR ART
FIG. 1A is a schematic block diagram illustrating the coaxial cable connections in a conventional, non-monolithic phased array antenna that uses a centralized phase shifter.

For example, FIG. 1A is a schematic block diagram illustrating the connections in a conventional phased array antenna 100 that uses a centralized adjustable electromechanical wiper arc phase shifter 130. As shown in FIG. 1A, the phased array antenna 100 includes a total of sixteen radiating elements 110-1 through 110-16. Herein, when the phased array antennas according to embodiments of the present invention include multiple of the same components, these components may be referred to individually by their full reference numerals (e.g., radiating element 110-1) and may be referred to collectively by the first part of their reference numeral (e.g., the radiating elements 110). In the figures, the radiating elements are shown as squares with an "X" shaped structure therein which depict radiating elements in the form of cross-polarized dipole antennas, and the reference numerals for each radiating element are positioned just to the left of the respective radiating elements.

As further shown in FIG. 1A, the phased array antenna 100 includes a plurality of feed boards 120-1 through 120-7, each of which has a respective subset of the radiating elements 110-1 through 110-16 mounted thereon. In particular, feed board 120-1 includes radiating elements 110-1 through 110-3, feed board 120-2 includes radiating elements 110-4 and 110-5, feed board 120-3 includes radiating elements 110-6 and 110-7, feed board 120-4 includes radiating elements 110-8 and 110-9, feed board 120-5 includes radiating elements 110-10 and 110-11, feed board 120-6 includes radiating elements 110-12 and 110-13, and feed board 120-7 includes radiating elements 110-14 through 110-16. The phase shifter 130 includes an input 132, a wiper arm 136 and seven outputs 134 (the outputs 134 are the circle and the ends of the arcs of the phase shifter 130 in FIG. 1A; only one output 134 is numbered to simplify the drawing). Note also that in the drawings the inputs to the various phase shifters (e.g., phase shifter 130 of FIG. 1A) cross over various coaxial cables and/or circuit traces at right angle crossings. These crossings do not represent electrical connections. A signal received at the input 132 of phase shifter 130 may be passed to all but one of the outputs 134 via the wiper arm 136. The wiper arm 136 may be a printed circuit board that is mounted for rotation on an underlying "main" printed circuit board, as is known to those of skill in the art and as described in the above-referenced U.S. Pat. No. 7,463,190. The phase shifter 130 may split the input signal. One component of the split signal may be delivered to a first of the outputs 134, and the remaining components of the split signal may be coupled to the respective remaining outputs 134 via the wiper arm 136. The wiper arm 136 and the underlying main printed circuit board may include arcuate traces, and the components of the signal fed to the wiper arm 136 may capacitively couple to the arcuate traces on the main printed circuit board. The wiper arm 136 may be rotated in order to change the distance that each component of the input signal must travel to reach its corresponding output 134, thereby applying a phase taper to the components of the input signal that are delivered to the outputs 134. As electromechanical wiper arm phase shifters are well known in the art further description of the wiper arm phase shifter 130 will be omitted.

Respective coaxial cables 140-1 through 140-7 connect the seven outputs 134 of the phase shifter 130 to the respective feed boards 120-1 through 120-7. Typically, a first end 142 of each coaxial cable 140 is soldered to a respective one of the outputs 134 of the phase shifter 130 and a second end 144 of each coaxial cable 140 is soldered to an input 122 of the respective feed boards 120. Thus, a total of fourteen solder joints must be performed to connect the seven outputs 134 of the phase shifter 130 to the inputs 122 of the respective seven feed boards 120.

Unfortunately, the above-described soldered cable connections increase the costs of manufacturing the phased array antenna 100, as the solder joints are typically formed manually. Moreover, the solder connections are a possible point of failure in the field (particularly as wind, temperature fluctuations, earthquakes and other environmental factors may impart stresses on the solder joints).

Additionally, solder joints are a potential source of passive intermodulation ("PIM") distortion. PIM distortion is a form of electrical interference that may occur when two or more RF signals encounter non-linear electrical junctions or materials along an RF transmission path. Inconsistent metal-to-metal contacts along the RF transmission path are one potential source for PIM distortion, particularly when such inconsistent contacts are in high current density regions of the transmission path. The non-linearities that arise may act like a mixer causing new RF signals to be generated at mathematical combinations of the original RF signals. If the newly generated RF signals fall within the bandwidth of existing RF signals, the noise level experienced by those existing RF signals is effectively increased. When the noise level is increased, it may be necessary reduce the data rate and/or the quality of service. PIM distortion can be an important interconnection quality characteristic for an RF communications system, as PIM distortion generated by a single low quality interconnection may degrade the electrical performance of the entire RF communications system. Thus, reducing the number of solder connections may reduce the opportunity for PIM to arise.

Figure 1B:
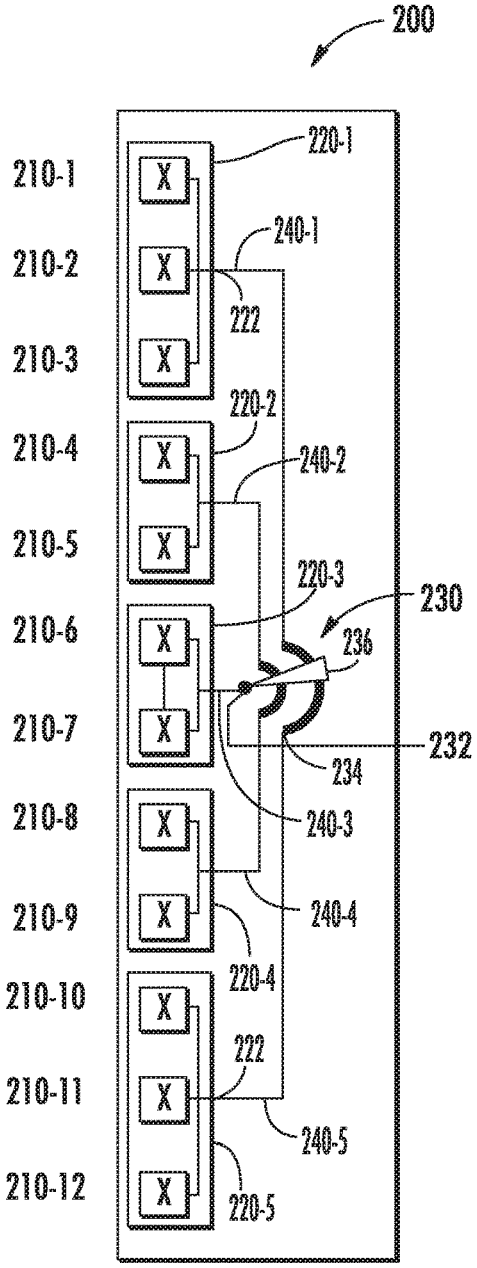
FIG. 1B PRIOR ART
FIG. 1B is a schematic block diagram illustrating the connections in another conventional, non-monolithic phased array antenna that uses a centralized phase shifter.

FIG. 1B is a schematic block diagram illustrating the connections in another conventional phased array antenna 200 that uses a centralized phase shifter 230. As shown in FIG. 1B, the phased array antenna 200 includes a total of twelve radiating elements 210-1 through 210-12 and five feed boards 220-1 through 220-5, each of which includes a respective subset of the radiating elements 210-1 through 210-12. The phase shifter 230 includes an input 232, five outputs 234 and a wiper arm 236. Coaxial cables 240-1 through 240-5 connect the outputs 234 of the phase shifter 230 to the respective feed boards 220-1 through 220-5. The coaxial cables 240 are soldered to the respective outputs 234 of the phase shifter 230 and to the respective feed boards 220. Thus, a total of ten solder joints must be performed to connect the five outputs 234 of the phase shifter 230 to the inputs 222 of the five respective feed boards 220.

Pursuant to embodiments of the present invention, phased array antennas are provided that include multi-level phase shifters. In some embodiments, these phased array antennas may comprise a base-level adjustable phase shifter that has a relatively small number of outputs which connect to the feed boards of the phased array antenna. Some or all of the feed boards may have an increased number of radiating elements mounted thereon as compared to a corresponding conventional design. Each feed board may also include an adjustable phase shifter mounted thereon (which is often referred to herein as a "feed board adjustable phase shifter"). The outputs of each feed board adjustable phase shifter may be connected to the respective radiating elements on the feed board via printed circuit board transmission lines. Since multiple radiating elements are included on each feed board, and a single coaxial cable feeds all of the radiating elements on each respective feed board, the total number of coaxial cables, and hence the number of solder joints required, may be reduced as compared to the corresponding conventional phased array antennas of FIGS. 1A-1B. Consequently, the manufacturing costs of the antenna may be decreased and the performance and reliability of the antenna may be improved by reducing the number of solder joints included therein.

For example, the conventional sixteen radiating element phased array antenna of FIG. 1A uses a total of seven coaxial cables 140 to connect outputs 134 of the centralized phase shifter 130 to the respective feed boards 120. For a quad antenna design that includes four linear arrays, a total of twenty-eight coaxial cables are required, which corresponds to fifty-six solder joints, as each end of each coaxial cable is connected using a solder joint. In contrast, a sixteen radiating element phased array antenna according to an example embodiment of the present invention only uses a total of three coaxial cables (six solder joints) to connect the base-level adjustable phase shifter to the feed boards. Thus, for a quad antenna design, a total of twelve coaxial cables are required which corresponds to twenty-four solder joints. This is a significant reduction that should reduce the manufacturing cost of the antenna and increase the reliability and performance thereof.

Aspects of the present invention will now be described in greater detail with reference to FIGS. 2A-2B, 3A-3C, 5A-5G and 7-10, in which embodiments of the present invention are shown.

Figure 2A:
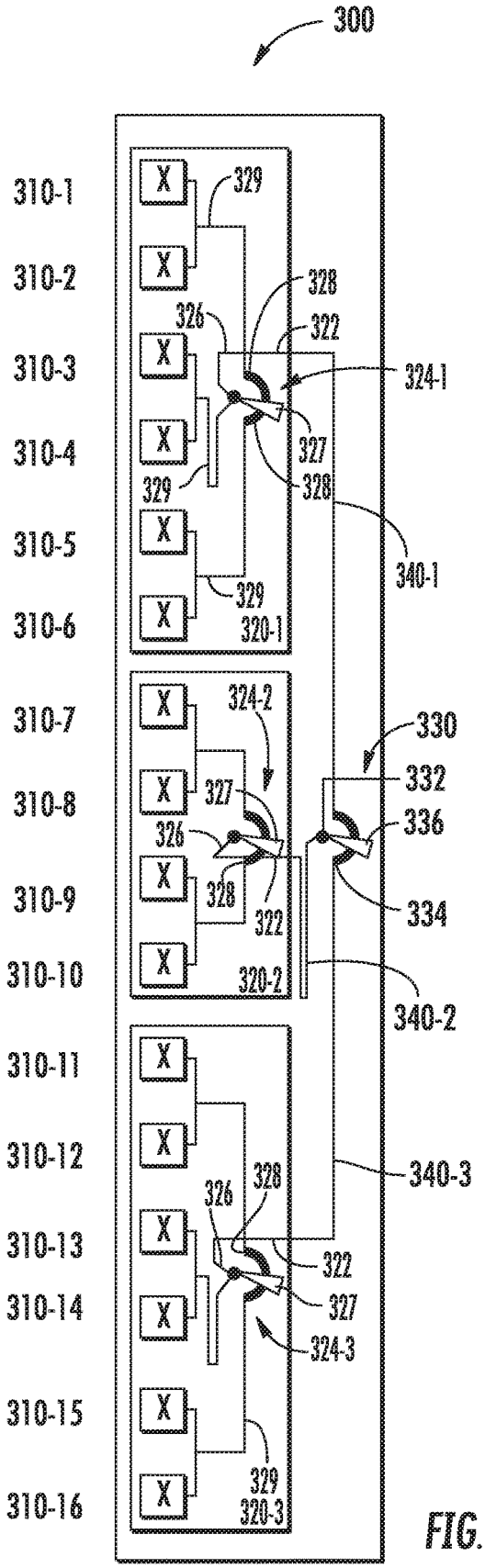
FIG. 2A is a schematic block diagram illustrating the connections in a phased array antenna according to embodiments of the present invention that uses a multi-level phase shifter approach.

FIG. 2A is a schematic block diagram of a phased array antenna 300 according to embodiments of the present invention that uses a multi-level phase shifter approach. The phased array antenna 300 may be used, for example, in place of the conventional phased array antenna 100 that is described above with reference to FIG. 1A.

As shown in FIG. 2A, the phased array antenna 300 includes sixteen radiating elements 310-1 through 310-16. Each radiating element 310 may comprise, for example, a pair of 45°/−45° cross-polarized dipole antennas, although embodiments of the present invention are not limited thereto. For example, in other embodiments, modified dipole antennas or patch antennas may be used. Other radiating elements may alternatively be used.

Three feed boards 320-1 through 320-3 are provided, each of which includes a respective subset of the radiating elements 301-316. Each feed board 320 comprises a monolithic element that includes a subset of the radiating elements 301-316, a feed board adjustable phase shifter 324 that has an input 326, a wiper arm 327 and outputs 328, and transmission lines 329 that connect the outputs 328 of the feed board adjustable phase shifter 324 to the radiating elements 301-316. In some embodiments, each feed board 320 may comprise a printed circuit board.

As shown in FIG. 2A, feed board 320-1 includes radiating elements 310-1 through 310-6 and a feed board adjustable phase shifter 324-1. The feed board adjustable phase shifter

324-1 comprises, for example, an electromechanical wiper arc phase shifter that is mounted on the feed board 320-1. The feed board adjustable phase shifter 324-1 includes an input 326, a plurality of outputs 328 and a wiper arm 327. A first transmission line 329 connects a first output 328 of the feed board adjustable phase shifter 324-1 to radiating elements 310-1 and 310-2. The first transmission line 329 may comprise, for example, a microstrip transmission line. As shown schematically in FIG. 2A, this first transmission line splits into two transmission lines to feed the two radiating elements 310-1 and 310-2. A second transmission line 329 connects a second output 328 of the feed board adjustable phase shifter 324-1 to radiating elements 310-3 and 310-4. A third transmission line 329 connects a third output 328 of the feed board adjustable phase shifter 324-1 to radiating elements 310-5 and 310-6. The second and third transmission lines 329 may be identical to the above-described first transmission line 329 except that they are used to connect different outputs 328 of the feed board adjustable phase shifter 324-1 to different radiating elements 310.

Feed boards 320-2 and 320-3 may be similar to feed board 320-1. Feed board 320-2 includes radiating elements 310-7 through 310-10 and a feed board adjustable phase shifter 324-2 that has an input 326, a wiper arm 327 and two outputs 328. A first transmission line 329 connects a first of the outputs 328 of the feed board adjustable phase shifter 324-2 to radiating elements 310-7 and 310-8, and a second transmission line 329 connects a second output 328 of the feed board adjustable phase shifter 324-2 to radiating elements 310-9 and 310-10. Feed board 320-3 includes radiating elements 310-11 through 310-16 and a feed board adjustable phase shifter 324-3 that has an input 326, a wiper arm 327 and three outputs 328. A first transmission line 329 connects the first output 328 of feed board adjustable phase shifter 324-3 to radiating elements 310-11 and 310-12, a second transmission line 329 connects the second output 328 of feed board adjustable phase shifter 324-3 to radiating elements 310-13 and 310-14, and a third transmission line 329 connects the third output 328 of feed board adjustable phase shifter 324-3 to radiating elements 310-15 and 310-16.

The antenna 300 also includes a base-level adjustable phase shifter 330. The adjustable phase shifter 330 includes an input 332, a wiper arm 336 and three outputs 334. Coaxial cables 340-1 through 340-3 connect the respective outputs 334 of the adjustable phase shifter 330 to the respective feed boards 320-1 through 320-3. The coaxial cables 340 are soldered to the respective outputs 334 of the adjustable phase shifter 330 and to the respective feed boards 320. Thus, a total of six solder joints must be performed to connect the three outputs 334 of the adjustable phase shifter 330 to the inputs 322 of the respective feed boards 320-1 through 320-3.

The centralized adjustable phase shifter 330 is referred to herein as a "base-level adjustable phase shifter" because it is located at the base or "root" level of a multi-level tree structure of phase shifters. The feed board adjustable phase shifters 324 are referred to herein as "upper-level adjustable phase shifters" because they are at a second (or higher) level of the multi-level tree structure of phase shifters.

Thus, the phased array antenna 300 requires less than half the solder joints that are used in the antenna 100 that has the same number of radiating elements. As discussed above, this reduction in solder joints may reduce manufacturing and testing costs and may improve the reliability of the antenna 300 as compared to the antenna 100. While the phased array antenna 300 does use a plurality of microstrip transmission lines 329, which generally have higher insertion losses as compared to the coaxial cables 140 used in antenna 100, the microstrip transmission lines 329 are of relatively short length since they extend from a middle of a feed board 320 to the radiating elements 310 that are implemented on that feed board 320. Thus, while this may result in a small increase in insertion loss along the transmission path to each respective radiating element 310, the increase in insertion loss may be acceptable.

The base-level adjustable phase shifter 330 and the upper-level feed board adjustable phase shifters 324 each comprise adjustable phase shifters which may be adjusted in response to a control signal. The same is true with respect to the base-level adjustable phase shifters and upper-level feed board adjustable phase shifters described below with respect to further embodiments of the present invention.

Figure 2B:
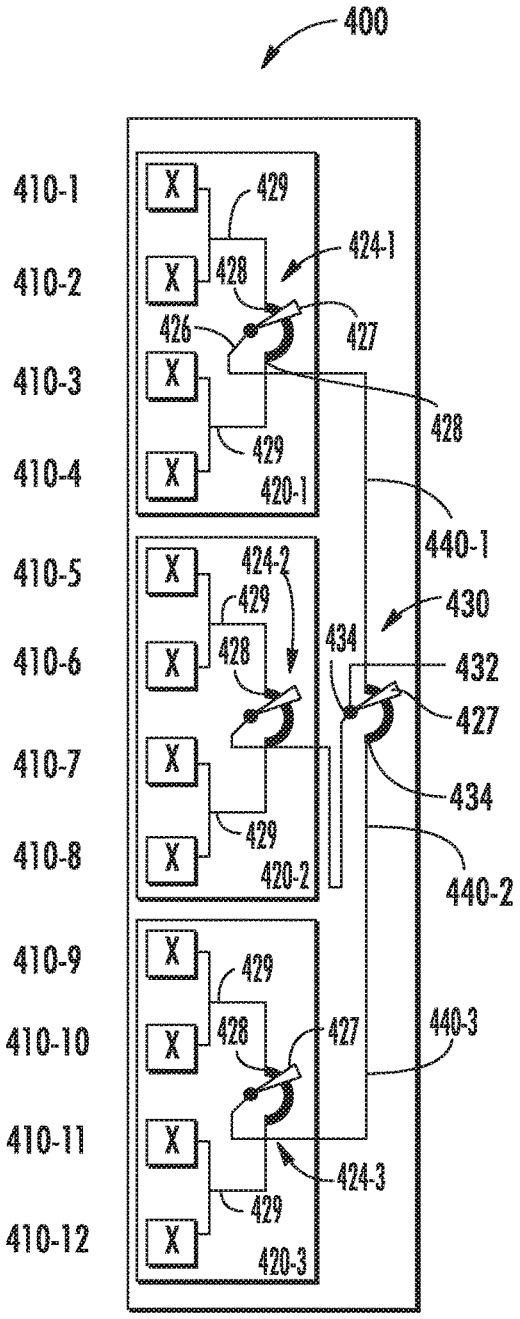
FIG. 2B is a schematic block diagram illustrating the connections in another phased array antenna according to embodiments of the present invention that uses a multi-level phase shifter approach.

FIG. 2B is a schematic block diagram of a phased array antenna 400 according to further embodiments of the present invention that may be used in place of the conventional phased array antenna 200 that is described above with reference to FIG. 1B. The phased array antenna 400 also uses a multi-level phase shifter approach. As shown in FIG. 2B, the phased array antenna 400 includes twelve radiating elements 410-1 through 410-12. Three feed boards 420-1 through 420-3 are provided. Each feed board 420 comprises a monolithic element that includes a respective subset of the radiating elements 410-1 through 410-12, a feed board adjustable phase shifter 424 that has an input 426, a wiper arm 427 and outputs 428, and transmission lines 429 that connect the outputs 428 of the feed board adjustable phase shifter 424 to the radiating elements 410-1 through 410-12.

Feed board 420-1 includes radiating elements 410-1 through 410-4 and a feed board adjustable phase shifter 424-1 that has an input 426, a wiper arm 427 and first and second outputs 428. A first transmission line 429 connects the first output 428 of the feed board adjustable phase shifter 424-1 to radiating elements 410-1 and 410-2. A second transmission line 429 connects the second output 428 of the feed board adjustable phase shifter 424-1 to radiating elements 410-3 and 410-4. The adjustable phase shifters 424 and the transmission lines 429 may be implemented in the same fashion as the adjustable phase shifters 324 and transmission lines 329 that are described above, and hence further description thereof will be omitted.

Feed board 420-2 includes radiating elements 410-5 through 410-8 and a feed board adjustable phase shifter 424-2 that has an input 426, a wiper arm 427 and first and second outputs 428. A first transmission line 429 connects the first output 428 of the feed board adjustable phase shifter 424-2 to radiating elements 410-5 and 410-6, and a second transmission line 429 connects the second output 428 of the feed board adjustable phase shifter 424-2 to radiating elements 410-7 and 410-8. Feed board 420-3 includes radiating elements 410-9 through 410-12 and a feed board adjustable phase shifter 424-3 that has an input 426, a wiper arm 427 and first and second outputs 428. A first transmission line 429 connects the first output 428 of feed board adjustable phase shifter 424-3 to radiating elements 410-9 and 410-10, and a second transmission line 429 connects the second output 428 of feed board adjustable phase shifter 424-3 to radiating elements 410-11 and 410-12. The antenna 400 also includes a base-level adjustable phase shifter 430 that has an input 432 and three outputs 434. Coaxial cables 440-1 through 440-3 connect the outputs 434 of phase shifter 430 to the respective feed boards 420-1 through 420-3. A total of six solder joints must be performed to connect the three outputs 434 of base-level adjustable phase shifter 430 to the respective feed boards 420-1 through 420-3. Thus, antenna 400 only requires 60% of the solder joints that are used in the conventional antenna 200 that has the same number of radiating elements.

Feed boards 320-2, 420-1, 420-2 and 420-3 may all be identical, as each of these feed boards includes four radiating elements and an adjustable phase shifter with two outputs. Feed boards 320-1 and 320-3 may also be identical to each other. Thus, antennas 300 and 400 may, in some cases, be implemented using a total of two feed board designs, which simplifies manufacturing and inventory control.

Figure 3A:
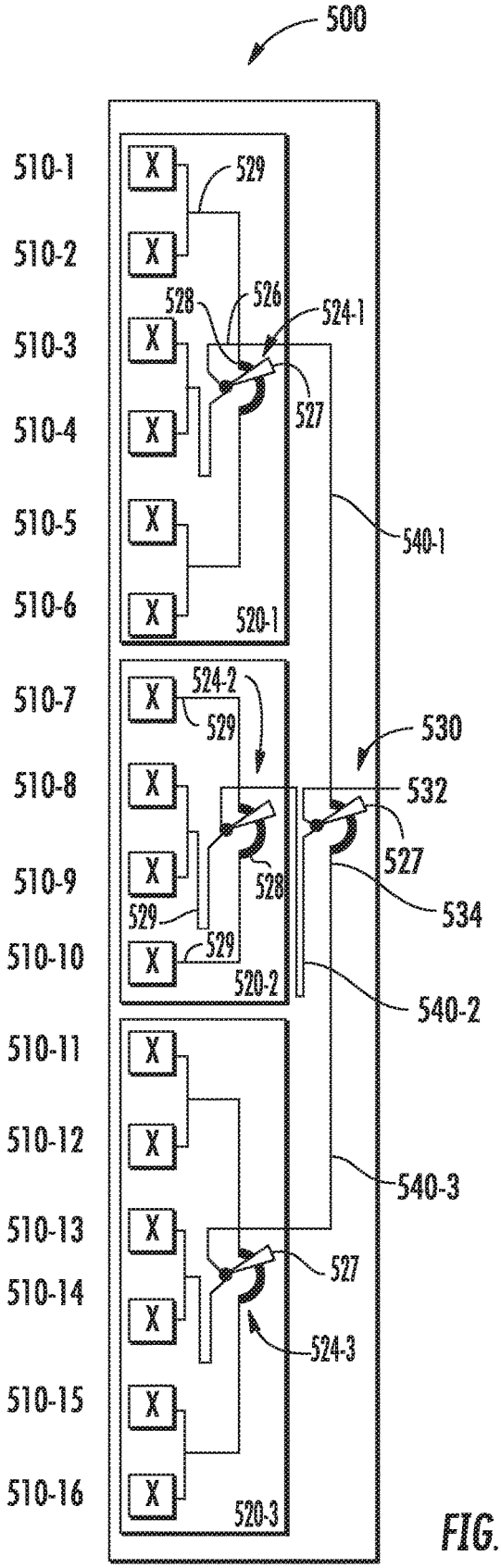
FIG. 3A is a schematic block diagram illustrating the connections in a phased array antenna according to further embodiments of the present invention.
Figure 3B:
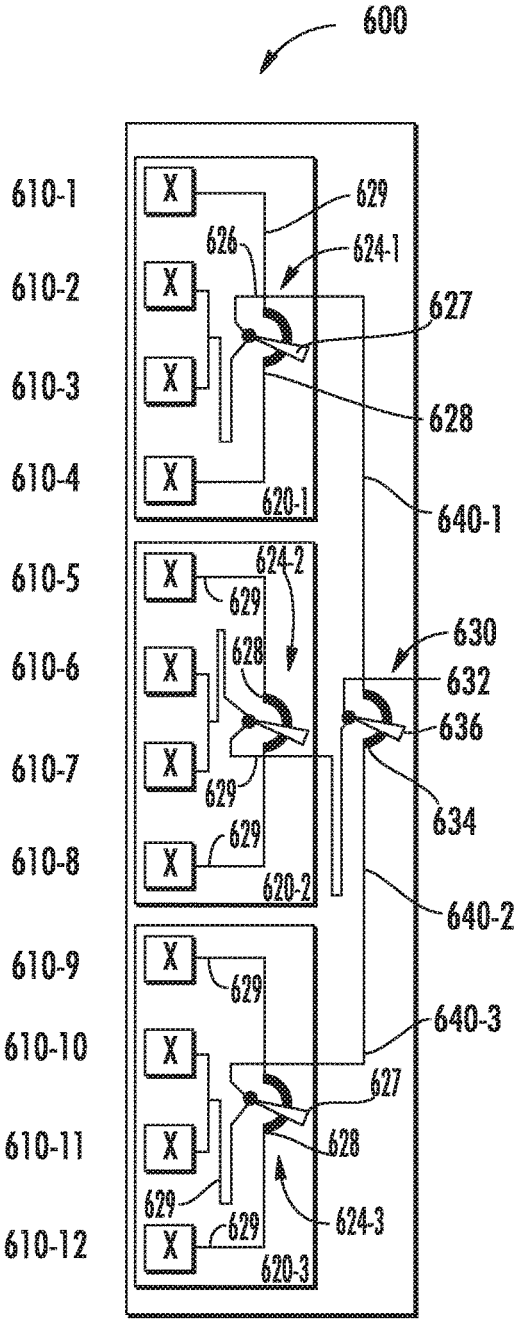
FIG. 3B is a schematic block diagram illustrating the connections in another phased array antenna according to still further embodiments of the present invention.
Figure 3C:
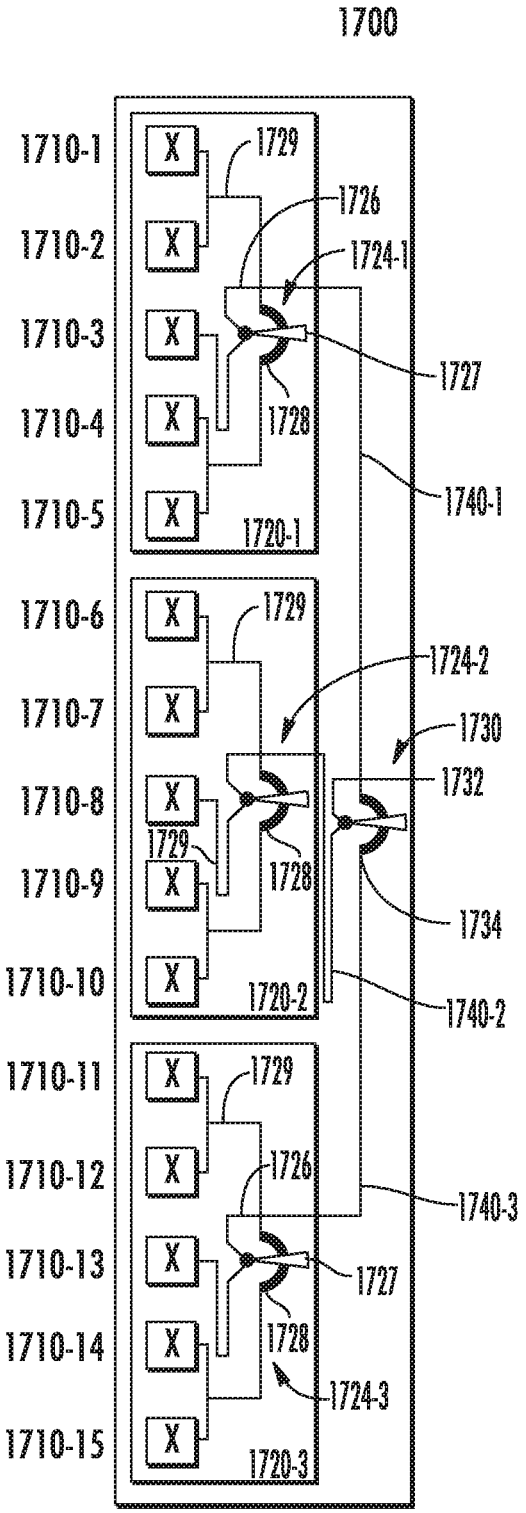
FIG. 3C is a schematic block diagram illustrating the connections in yet another phased array antenna according to embodiments of the present invention.

The phased array antennas 300 and 400 of FIGS. 2A and 2B, respectively, include both adjustable phase shifters that have two outputs and adjustable phase shifters that have three outputs. FIGS. 3A through 3C schematically illustrate sixteen, twelve and fifteen element phased array antennas, respectively, according to still further embodiments of the present invention where all of the adjustable phase shifters have three outputs.

As shown in FIG. 3A, a phased array antenna 500 according to embodiments of the present invention includes sixteen radiating elements 510-1 through 510-16. Phased array antenna 500 includes a base-level adjustable phase shifter 530 which may or may not be identical to the base-level adjustable phase shifter 330 of antenna 300, and hence further description thereof will be omitted. Phased array antenna 500 further includes three feed boards 520-1 through 520-3, each of which includes a respective subset of the radiating elements 510-1 through 510-16. Feed boards 520-1 and 520-3 may be identical to feed boards 320-1 and 320-3 of antenna 300, and hence further description thereof will likewise be omitted herein. Feed board 520-2 includes feed board adjustable phase shifter 524-2 that has three outputs 528 that are used to feed radiating elements 510. In particular, on feed board 520-2, a first transmission line 529 connects a first output 528 of feed board adjustable phase shifter 524-2 to radiating element 510-7, a second transmission line 529 connects a second output 528 of feed board adjustable phase shifter 524-2 to radiating elements 510-8 and 510-9, and a third transmission line 529 connects a third output 528 of feed board adjustable phase shifter 524-2 to radiating element 510-10. Each feed board adjustable phase shifter 524 may comprise an electromechanical wiper arc phase shifter having a wiper arm 527 that is mounted on a respective one of the feed boards 520.

Like the phased array antenna 300, the phased array antenna 500 includes three coaxial cables 540-1 through 540-3 that connect the three outputs 534 of the base-level adjustable phase shifter 530 to the respective feed boards 520-1 through 520-3. Thus, the antenna 500 likewise includes a total of six solder joints.

As shown in FIG. 3B, a phased array antenna 600 according to embodiments of the present invention includes twelve radiating elements 610-1 through 610-12. Phased array antenna 600 includes a base-level adjustable phase shifter 630 having a wiper arm 636 which may be identical to the base-level adjustable phase shifter 430 of antenna 400, and hence further description thereof will be omitted, Phased array antenna 600 includes three feed boards 620-1 through 620-3. Each feed board 620 includes a feed board adjustable phase shifter 624 having a wiper arm 627 that is mounted on the feed board 620. Feed boards 620-1 through 620-3 each has an adjustable phase shifter 624 that has three outputs 628, where two of the outputs 628 of each such adjustable phase shifter 624 feed a single respective radiating element 610 while the third output 628 feeds two radiating elements 610.

As shown in FIG. 3C, a phased array antenna 1700 according to embodiments of the present invention includes fifteen radiating elements 1710-1 through 1710-15. Phased array antenna 1700 includes a base-level adjustable phase shifter 1730 which may, for example, be similar or identical to the base-level adjustable phase shifter 330 of antenna 300, and hence further description thereof will be omitted. Phased array antenna 1700 further includes three feed boards 1720-1 through 1720-3, each of which includes a respective subset of the radiating elements 1710-1 through 1710-15. Feed boards 1720-1 through 1720-3 may each include five of the radiating elements 1710 and a feed board adjustable electromechanical wiper arc phase shifter 1724 that has an input 1726, a wiper arm 1727 and three outputs 1728. Microstrip or other first transmission lines 1729 connect each output 1728 of the feed board adjustable phase shifters 1724 to the radiating elements 1710. The phased array antenna 1700 includes three coaxial cables 1740-1 through 1740-3 that connect the three outputs 1734 of the base-level adjustable phase shifter 1730 to the respective feed boards 1720-1 through 1720-3. Thus, the antenna 1700 likewise includes a total of six solder joints.

Phased array antennas often include multiple sets of radiating elements. For example, phased array antennas routinely include at least one set of radiating elements that transmits and receives signals in a first frequency band and a second set of radiating elements that transmits and receives signals in a second, different frequency band. The frequency band at the higher frequencies is typically referred to as the "high band" and the frequency band at the lower frequencies is typically referred to as the "low band." In some embodiments, the phased array antennas 300, 400, 500 and 600 that are described above may be used to implement the high band array(s) on a phased array antenna.

Figure 4A:
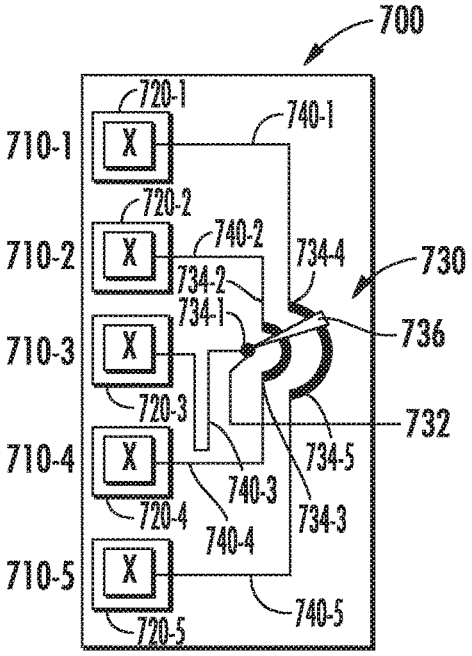
FIG. 4A PRIOR ART
FIGS. 4A-4C are schematic block diagrams illustrating the coaxial cable connections in three additional conventional phased array antennas.

FIG. 4A is a schematic block diagram illustrating the connections for a low band array in a conventional phased array antenna 700 that uses a centralized adjustable phase shifter 730. The phased array antenna 700 includes five radiating elements 710-1 through 710-5, each of which is mounted on a respective feed board 720-1 through 720-5. The adjustable phase shifter 730 includes an input 732, a wiper arm 736 and five outputs 734-1 through 734-5. Respective coaxial cables 740-1 through 740-5 connect the outputs 734-1 through 734-5 of the phase shifter 730 to the respective feed boards 720-1 through 720-5 via a total of ten soldered connections.

Figure 4B:
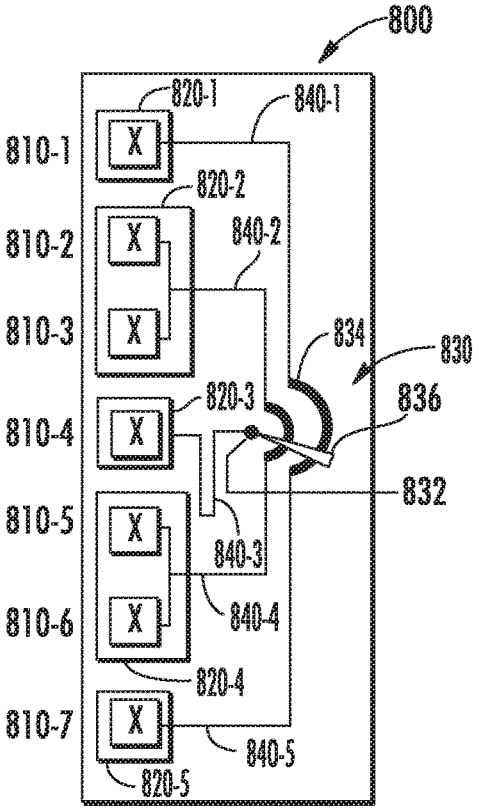
FIG. 4B PRIOR ART

FIG. 4B is a schematic block diagram of the connections for a low band array another conventional phased array antenna 800 that uses a centralized adjustable phase shifter 830. The phased array antenna 800 includes seven radiating elements 810-1 through 810-7 that are mounted on five feed boards 820-1 through 820-5. The adjustable phase shifter 830 has an input 832, a wiper arm 836 and five outputs 834 (only one output 834 is numbered in FIG. 4B to simplify the drawing). Coaxial cables 840-1 through 840-5 connect the five outputs 834 of the adjustable phase shifter 830 to the respective feed boards 820-1 through 820-5 via a total of ten soldered connections.

Figure 4C:
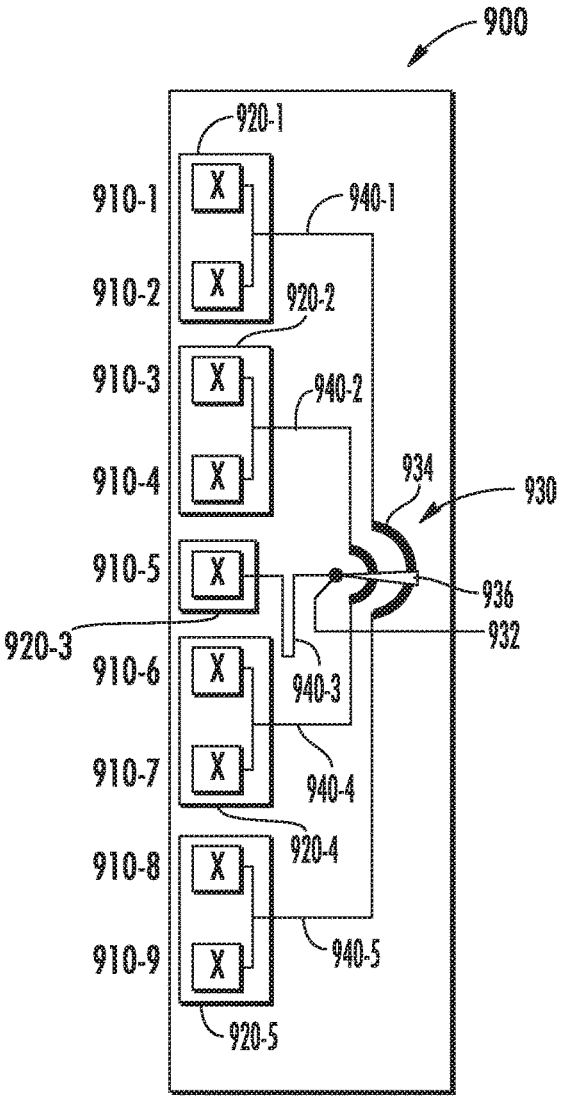
FIG. 4C PRIOR ART

FIG. 4C is a schematic block diagram of the connections for a low band array of yet another conventional phased array antenna 900 that uses a centralized adjustable phase shifter 930. The phased array antenna 900 includes nine radiating elements 910-1 through 910-9 that are mounted on five feed boards 920-1 through 920-5. The adjustable phase shifter 930 has an input 932, a wiper arm 936 and five outputs 934. Coaxial cables 940-1 through 940-5 connect the five outputs 934 of the adjustable phase shifter 930 to the respective feed boards 920-1 through 920-5 via a total of ten soldered connections.

Figure 5A:
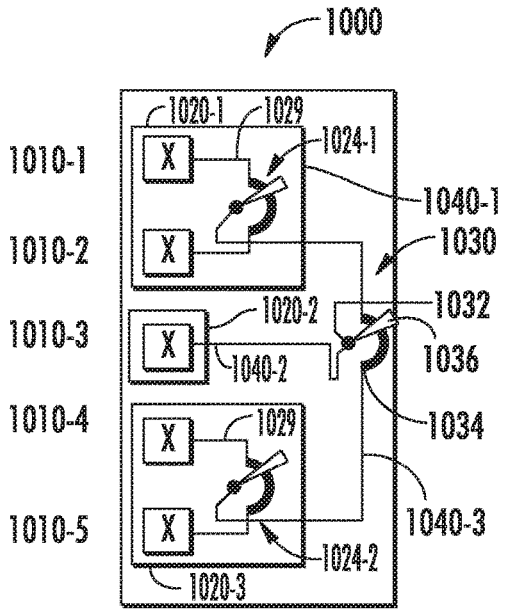
FIGS. 5A and 5B are schematic block diagrams illustrating the connections in phased array antennas according to embodiments of the present invention that may be used in place of the antenna of FIG. 4A.

FIGS. 5A-5E depict the connections for several low band arrays according to embodiments of the present invention. As shown in FIG. 5A, a phased array antenna 1000 includes five radiating elements 1010-1 through 1010-5. A base-level adjustable phase shifter 1030 has an input 1032, a wiper arm 1036 and three outputs 1034 that connect to respective feed boards 1020-1 through 1020-3 via coaxial cables 1040-1 through 1040-3 (a total of six soldered connections). Each feed board 1020-1 through 1020-3 has a respective subset of the radiating elements 1010-1 through 1010-5 mounted thereon and feed boards 1020-1 and 1020-3 each include a respective 1×2 feed board adjustable phase shifter 1024-1, 1024-3. The outputs of the feed board adjustable phase shifters 1024-1, 1024-3 are connected to the respective radiating elements 1010-1, 1010-2; 1010-4, 1010-5 on the respective feed boards 1020-1, 1020-3 via transmission lines 1029.

Figure 5B:
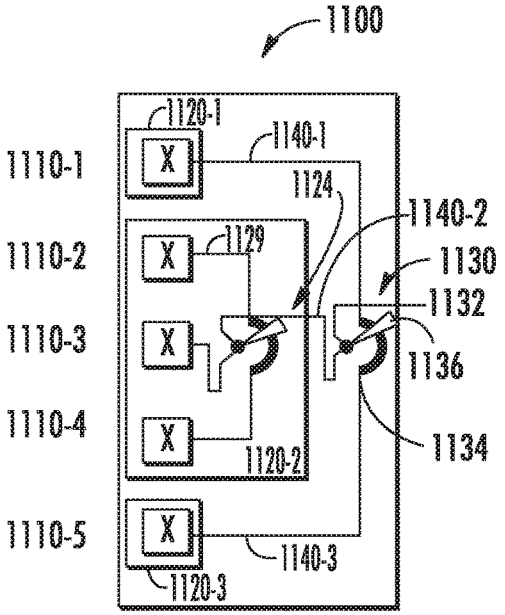

As shown in FIG. 5B, a phased array antenna 1100 includes five radiating elements 1110-1 through 1110-5. A base-level adjustable phase shifter 1130 has an input 1132, a wiper arm 1136 and three outputs 1134 that connect to respective feed boards 1120-1 through 1120-3 via coaxial cables 1140-1 through 1140-3 (a total of six soldered connections). Each feed board 1120-1 through 1120-3 has a respective subset of the radiating elements 1110-1 through 1110-5 mounted thereon. Feed board 1120-2 include a respective 1×3 feed board adjustable phase shifter 1124. The outputs of the feed board adjustable phase shifter 1124 are connected to the respective radiating elements 1110-2 through 1110-4 on the feed board 1120-2 via transmission lines 1129.

Figure 5C:
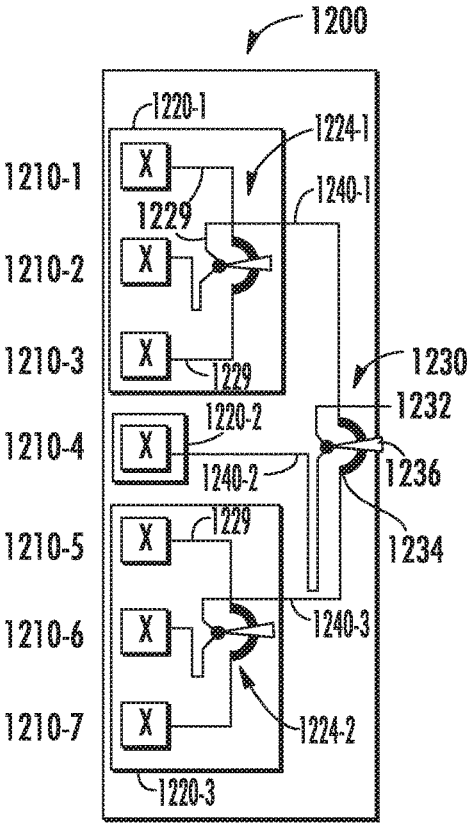
FIGS. 5C and 5D are schematic block diagrams illustrating the connections in phased array antennas according to embodiments of the present invention that may be used in place of the antenna of FIG. 4B.

As shown in FIG. 5C, a phased array antenna 1200 includes seven radiating elements 1210-1 through 1210-7. A base-level adjustable phase shifter 1230 has an input 1232, a wiper arm 1236 and three outputs 1234 that connect to respective feed boards 1220-1 through 1220-3 via coaxial cables 1240-1 through 1240-3 (a total of six soldered connections). Each feed board 1220-1 through 1220-3 has a respective subset of the radiating elements 1210-1 through 1210-7 mounted thereon. Feed boards 1220-1 and 1220-3 include respective 1×3 feed board phase shifters 1224-1, 1224-2. The outputs of the feed board phase shifters 1224-1, 1224-2 are connected to the respective radiating elements 1210-1, 1210-2, 1210-3; 1210-5, 1210-6, 1210-7 via transmission lines 1229.

Figure 5D:
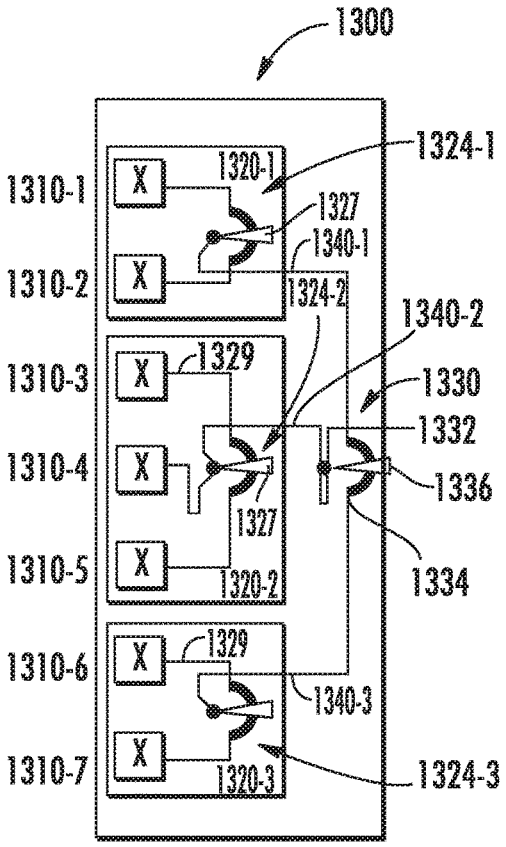

As shown in FIG. 5D, a phased array antenna 1300 includes seven radiating elements 1310-1 through 1310-7. A base-level adjustable phase shifter 1330 has an input 1332, a wiper arm 1336 and three outputs 1334 that connect to respective feed boards 1320-1 through 1320-3 via coaxial cables 1340-1 through 1340-3 (a total of six soldered connections). Each feed board 1320-1 through 1320-3 has a respective subset of the radiating elements 1310-1 through 1310-7 mounted thereon. Feed boards 1320-1 and 1320-3 each include a 1×2 feed board adjustable phase shifter 1324-1, 1324-3 and feed board 1320-2 includes a 1×3 feed board phase adjustable shifter 1324-2. Each feed board adjustable phase shifter 1324 includes a wiper arm 1327. The outputs of the feed board adjustable phase shifters 1324-1 through 1324-3 are connected to the respective radiating elements 1310-1 through 1310-7 via transmission lines 1329.

Figure 5E:
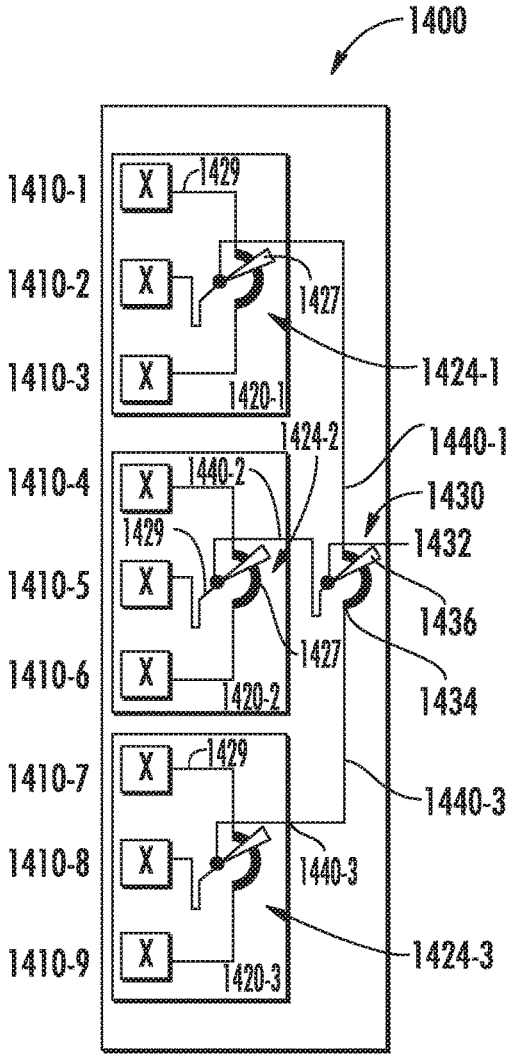
FIG. 5E is a schematic block diagram illustrating the connections in a phased array antenna according to embodiments of the present invention that may be used in place of the antenna of FIG. 4C.

As shown in FIG. 5E, a phased array antenna 1400 includes nine radiating elements 1410-1 through 1410-9. A base-level adjustable phase shifter 1430 has an input 1432, a wiper arm 1436 and three outputs 1434 that connect to respective feed boards 1420-1 through 1420-3 via coaxial cables 1440-1 through 1440-3 (a total of six soldered connections). Each feed board 1420-1 through 1420-3 has a respective subset of the radiating elements 1410-1 through 1410-9 mounted thereon. Feed boards 1420-1 through 1420-3 each include a respective 1×3 feed board adjustable phase shifter 1424-1 through 1424-3. Each feed board adjustable phase shifter 1424 includes a wiper arm 1427. The outputs of the feed board adjustable phase shifters 1424-1 through 1424-3 are connected to the respective radiating elements 1410-1 through 1410-9 via transmission lines 1429.

Figure 5F:
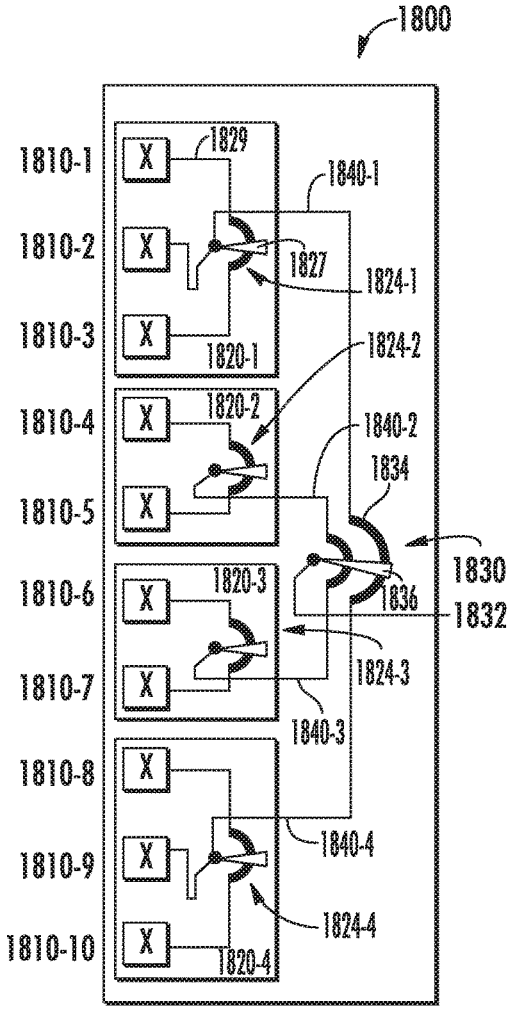
FIGS. 5F and 5G are schematic block diagrams illustrating the connections in phased array antennas according to further embodiments of the present invention.

As shown in FIG. 5F, a phased array antenna 1800 includes ten radiating elements 1810-1 through 1810-10. A base-level adjustable phase shifter 1830 has an input 1832, a wiper arm 1836 and four outputs 1834 that connect to respective feed boards 1820-1 through 1820-4 via coaxial cables 1840-1 through 1840-4 (a total of eight soldered connections). Each feed board 1820-1 through 1820-4 has a respective subset of the radiating elements 1810-1 through 1810-10 mounted thereon. Feed boards 1820-1 and 1820-4 each include a respective 1×3 feed board adjustable phase shifter 1824-1 and 1824-4 and feed boards 1820-2 and 1820-3 each include a respective 1×2 feed board adjustable phase shifter 1824-2 and 1824-3. Each feed board adjustable phase shifter 1824 includes a wiper arm 1827. The outputs of the feed board adjustable phase shifters 1824-1 through 1824-4 are connected to the respective radiating elements 1810-1 through 1810-10 via transmission lines.

Figure 5G:
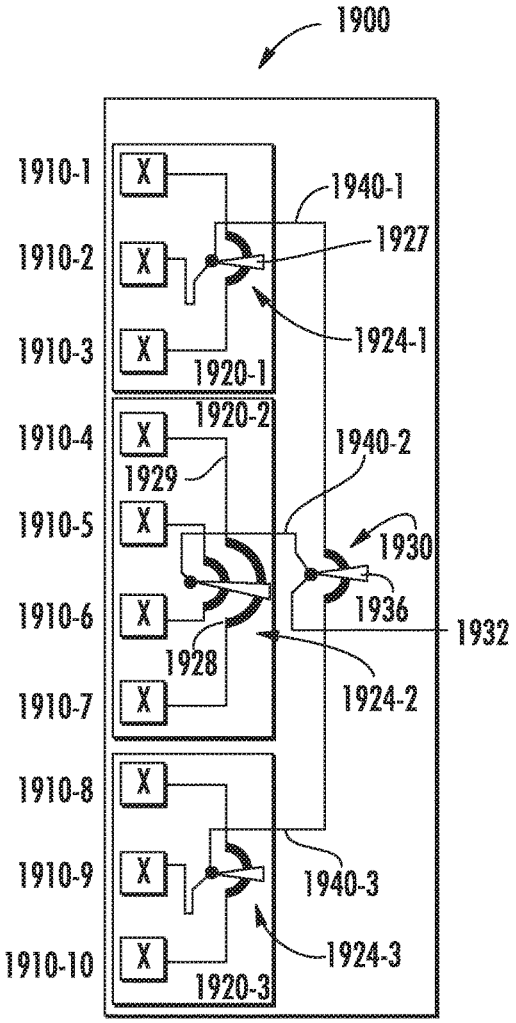

As shown in FIG. 5G, a phased array antenna 1900 includes ten radiating elements 1910-1 through 1910-10. A base-level adjustable phase shifter 1930 has an input 1932, a wiper arm 1936 and four outputs 1934 that connect to respective feed boards 1920-1 through 1920-3 via coaxial cables 1940-1 through 1940-3 (a total of six soldered connections). Each feed board 1920-1 through 1920-3 has a respective subset of the radiating elements 1910-1 through 1910-10 mounted thereon. Feed boards 1920-1 and 1920-3 each include a respective 1×3 feed board adjustable phase shifter 1924-1 and 1924-3 and feed board 1920-2 includes a 1×4 feed board adjustable phase shifter 1924-2. Each feed board adjustable phase shifter 1924 includes a wiper arm 1927. The outputs 1928 of the feed board adjustable phase shifters 1924-1 through 1924-3 are connected to the respective radiating elements 1910-1 through 1910-10 via transmission lines 1929.

The phased array antennas according to embodiments of the present invention use multiple levels of phase shifters (i.e., a base-level adjustable phase shifter and at least one upper-level adjustable phase shifter) to reduce the number of solder connections as compared to conventional phased array antennas. This may be beneficial for one or more reasons. As discussed above, solder connections are a potential source of PIM distortion. PIM distortion can degrade an entire RF system, and hence elimination of any potential sources of PIM distortion may be very valuable. Additionally, solder connections are typically formed by hand and hence are labor intensive. Solder connections also comprise a potential point of failure in the RF path. Thus, the phased array antennas according to embodiments of the present invention may have reduced cost, improved performance and/or increased reliability.

Figure 6A:
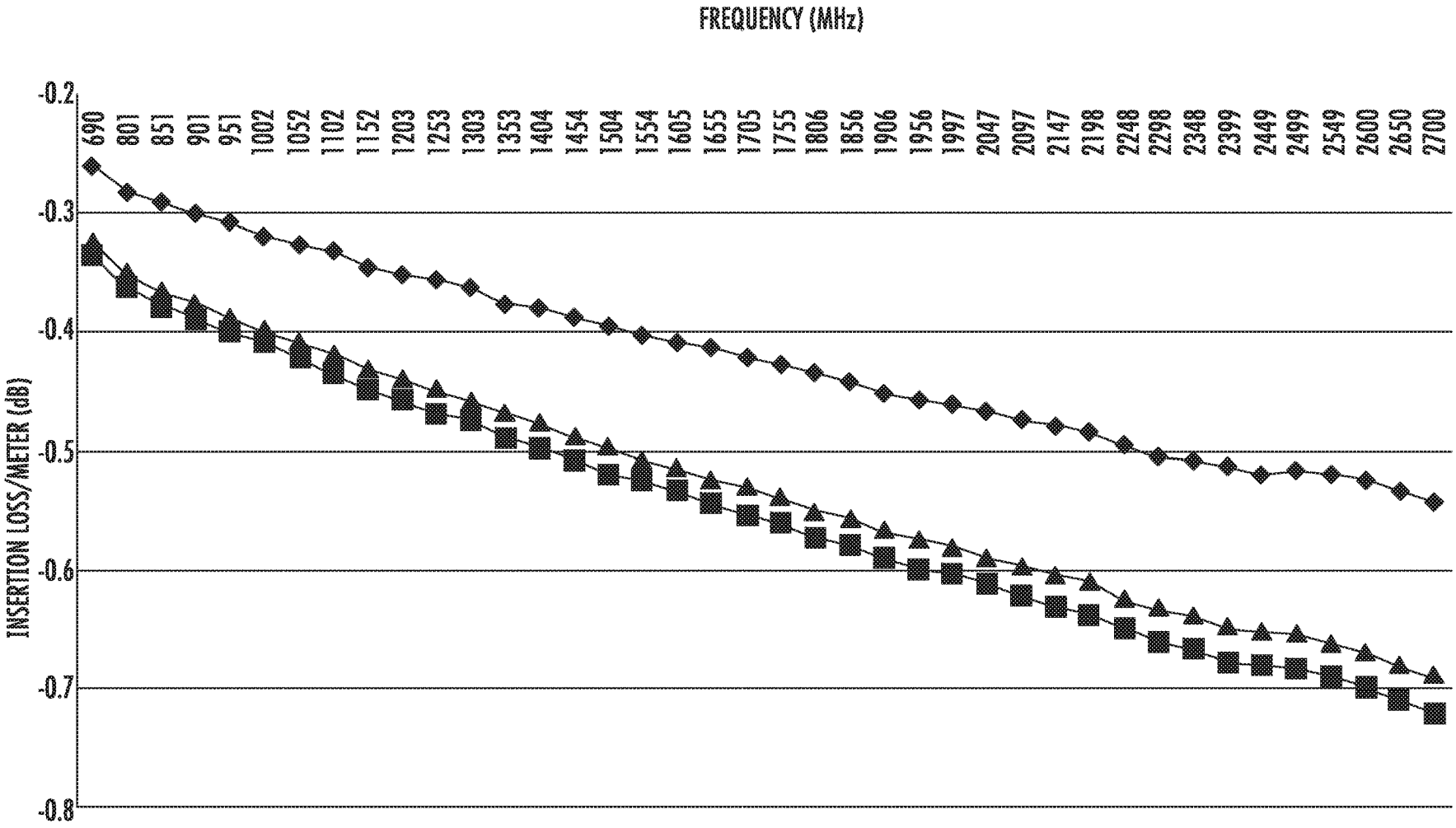
FIG. 6A is a graph illustrating the insertion loss per meter as a function of frequency for several example coaxial cables.
Figure 6B:
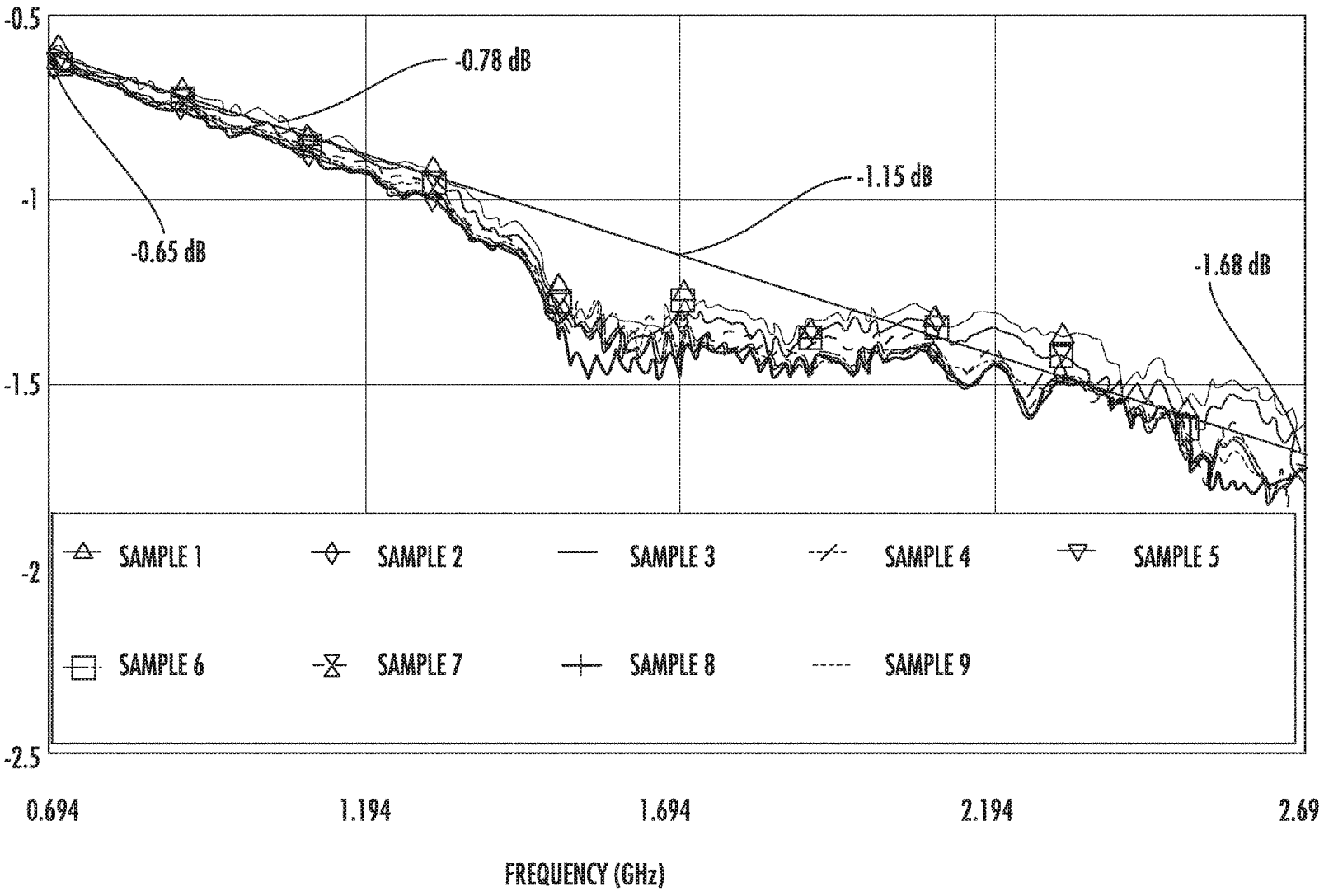
FIG. 6B is a graph illustrating the insertion loss per meter as a function of frequency for transmission lines on several sample printed circuit boards.

Another consideration is the insertion loss associated with the different phased array antenna designs. Generally speaking, relatively inexpensive printed circuit boards are used to implement the feed boards based on cost considerations. As noted above, the transmission lines on these lower cost feed boards may exhibit higher insertion losses than coaxial cables, which is one of the reasons that fully monolithic feed boards may be impractical in certain cases. FIG. 6A shows the insertion loss per meter (m) as a function of frequency for several example coaxial cables that are suitable for use in base station antennas. As shown in FIG. 6A, the insertion loss is relatively linear and ranges from about 0.3 dB/m at 690 MHz to about 0.6 dB/m at 2.7 GHz. FIG. 6B shows the insertion loss per meter as a function of frequency for transmission lines on sample printed circuit boards of the cost and quality that are routinely used in base station antennas. As shown in FIG. 6B, the insertion loss ranges from about 0.65 dB/m at 690 MHz to about 1.7 dB/m at 2.7 GHz. Thus, the printed circuit board transmission lines are expected to increase the insertion loss, but since these transmission lines are relatively short (e.g., less than 0.25 meters in most cases), this increase in insertion loss is manageable.

The antennas according to embodiments of the present invention also add a second level of phase shifters, which is another potential source for an increase in insertion loss (as two phase shifters are provided along the respective transmission paths to each radiating element). However, the insertion loss of conventional phase shifters for phased array antennas generally increases with an increasing number of outputs on the phase shifter. Consequently, it is anticipated that the multi-tiered arrangement of phase shifters used in the phased array antennas according to embodiments of the present invention may exhibit about the same, or even lower, insertion losses than the corresponding insertion loss associated with the single level of phase shifters employed in conventional phased array antennas.

As discussed above, the phase shifters used in the phase array antennas according to embodiments of the present invention may be used to electronically adjust the elevation angle ("tilt") of the radiation pattern of the antenna. Thus, the phase shifters used in the antennas according to embodiments of the present invention may be adjustable phase shifters that may be adjusted using a control signal. Any conventional phase shifters may be used in the antennas according to embodiments of the present invention such as, for example, the wiper arc phase shifters disclosed in U.S. Pat. No. 7,463,190 ("the '190 patent"). Other suitable adjustable phase shifters are disclosed, for example, in U.S. Pat. Nos. 8,674,787 and 8,674,788, the disclosure of each of which is incorporated herein by reference. The '190 patent discloses variable phase shifters that have an input and a plurality of outputs that include a stationary printed circuit board and a mechanically rotatable printed circuit board mounted thereon. The rotatable printed circuit board may include multiple capacitively-coupled sections of different radii which couple to arcs on the stationary printed circuit board and thus create different lengths, which changes the electrical path length for at least some of the paths, typically by different amounts. This change in path length adjusts the phase.

In the above-described embodiments, at least two levels of phase shifters are incorporated into the feed network that is used to feed the radiating elements of a linear array. Each of the radiating elements is designed to transmit and receive signals in a particular frequency band. A multi-level phase shifter approach is used to reduce the number of solder joints in the antenna. It should be noted that a multi-level phase shifter approach has been used for other purposes. In particular, U.S. patent application Ser. No. 14/812,339 ("the '339 application") discloses a phased array antenna which uses a multi-level phase shift approach that includes course and fine phase shifters in order to reduce the number of diplexers that are required in a diplexed phased array antenna having antenna elements that transmit and receive signals on two different but relatively closely-spaced frequency bands. The '339 application does not disclose or suggest using a multi-level phase shifter approach to reduce the number of solder joints nor does it disclose the arrangements between the feed boards and phase shifters that allow the reduction in solder joints to be achieved.

Figure 7:
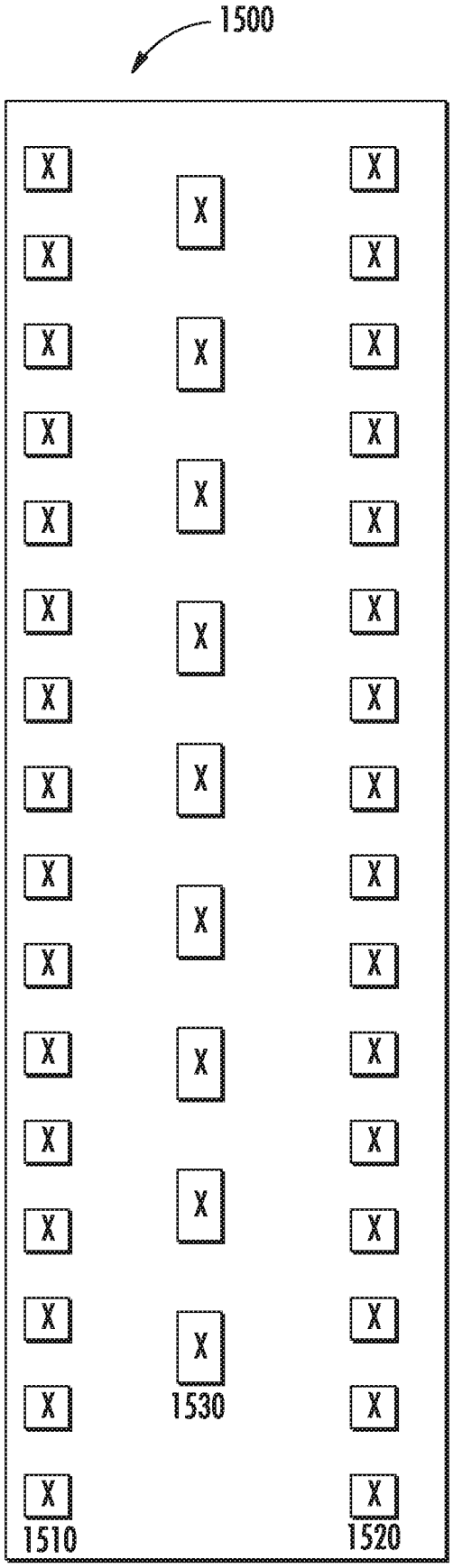
FIG. 7 is a schematic block diagram of a phased array antenna according to still further embodiments of the present invention.

It will also be appreciated that in many cases multiple arrays of radiating elements may be mounted on the same flat panel of a phased array antenna. For example, a very typical phased array antenna design includes two linear arrays of high band radiating elements and one linear array of low band radiating elements. It will be appreciated that in such phased array antennas one or more of these multiple arrays may use the multi-level phase shifter approaches disclosed herein. For example, FIG. 7 is a schematic block diagram of a phased array antenna 1500 according to still further embodiments of the present invention. As shown in FIG. 7, the phased array antenna includes a first high band linear array of radiating elements 1510, a second high band linear array of radiating elements 1520, and a third low band linear array of radiating elements 1530. Each of the high band linear arrays 1510, 1520 may be implemented according to any of the embodiments disclosed herein, as can the linear array 1530 of low band radiating elements.

Figure 8:
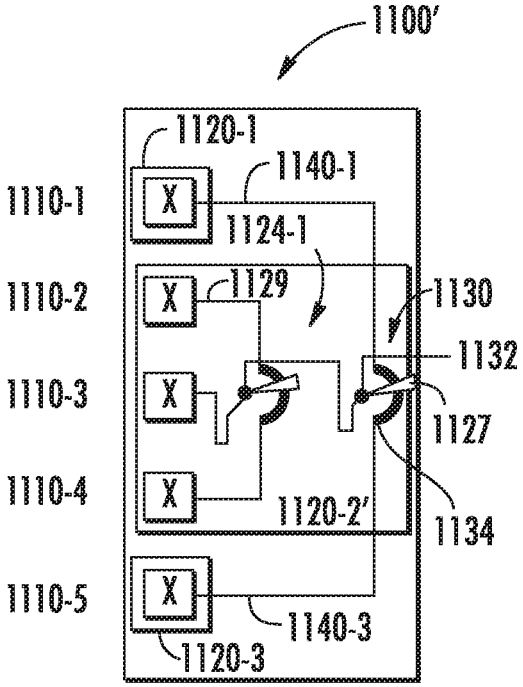
FIG. 8 is a schematic block diagram of a phased array antenna according to yet additional embodiments of the present invention in which the centralized phase shifter is mounted on one of the feed boards.

In the embodiments of the present invention that are described above, the base-level adjustable phase shifter was mounted separately from the feed boards. In other embodiments, the base-level adjustable phase shifter may be mounted on one of the feed boards along with one of the feed board adjustable phase shifters. Such a configuration is illustrated in FIG. 8. The phased array antenna 1100' of FIG. 8 is identical to the phased array antenna 1100 of FIG. 5B, except that feed board 1120-2' is larger than feed board 1120-2 to accommodate mounting the base-level adjustable phase shifter 1130 thereon. It will be appreciated that a similar change may be made to all of the above-described embodiments to provide a plurality of additional embodiments. One potential advantage of mounting the base-level adjustable phase shifter on one of the feed boards is that it may eliminate the need for one of the coaxial cables (for example, phased array antenna 1100' of FIG. 8 only includes two coaxial cables, 1140-1 and 1140-3). In some cases in which the base-level adjustable phase shifter is mounted on one of the feed boards, it may be mounted on a feed board that has some of the radiating elements in the center of the array mounted thereon to reduce the necessary length of the longest coaxial cables.

Figure 9:
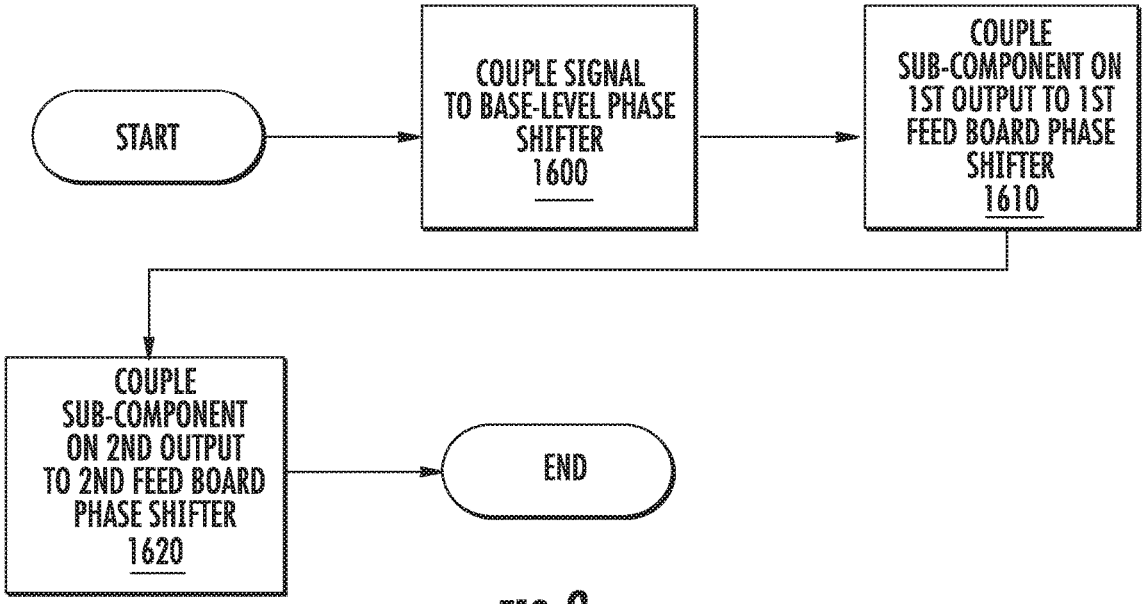
FIG. 9 is a flow chart illustrating a method of transmitting a signal through a phased array antenna pursuant to embodiments of the present invention.

Pursuant to further embodiments of the present invention, methods of transmitting a signal through a phased array antenna that has a plurality of radiating elements are provided. FIG. 9 is a flow chart illustrating one such method. As shown in FIG. 9, operations may begin by coupling a signal that is to be transmitted to a base-level adjustable phase shifter that has a plurality of outputs (Block 1600). The base-level adjustable phase shifter may split the signal into multiple sub-components and each output of the base-level adjustable phase shifter may include one of the sub-components. Phases of respective sub-components of the signal that are passed to each output may be different from one another. Next, a first of the outputs of the base-level adjustable phase shifter is coupled to an input of a first adjustable phase shifter that is mounted on a first feed board that includes a first subset of the radiating elements mounted thereon (Block 1610). At least two of the outputs of the first adjustable phase shifter are each connected to one or more of the radiating elements in the first subset of radiating elements by respective transmission lines on the first feed board. At the same time a second of the outputs of the base-level adjustable phase shifter may be coupled to an input of a second adjustable phase shifter that is mounted on a second feed board that includes a second subset of the radiating elements (Block 1620). At least two of the outputs of the second adjustable phase shifter are each connected to one or more of the radiating elements in the second subset of radiating elements by respective transmission lines on the second feed board.

In some embodiments, the first and second feed boards may be part of a plurality of feed boards, and each output of the base-level adjustable phase shifter may be connected by a respective one of a plurality of coaxial cables to a respective one of the plurality of feed boards. In some embodiments, the plurality of coaxial cables may be the only coaxial cables interposed on the RF transmission paths between an input to the first base-level adjustable phase shifter and the radiating elements.

As discussed above, various embodiments of the present invention include both first and second levels of phase shifters. For example, in the embodiment of FIG. 2A, phase shifter 330 forms a first level and is used to drive three second level phase shifters, namely feed board adjustable phase shifters 324-1 through 324-3. As is known to those of skill in the art, remote electronic tilt units which may comprise a motor and a processor may be used to physically move the wiper arms on electromechanical wiper arm phase shifters such as the phase shifters discussed herein. Typically, the wiper arms of the phase shifters are connected to the motor(s) via mechanical linkages. The motor(s) may apply forces that are transferred through the mechanical linkages in order to adjust the wiper arms to positions that apply desired phase tapers to the RF signals fed to and from the radiating elements.

In some embodiments of the present invention, a common mechanical linkage may be used to drive both a first level phase shifter and one or more second level phase shifters. In particular, the radii of the arcs included on the phase shifters and the gear ratios of the mechanical linkage may be selected so that the appropriate amount of linear travel will be applied to phase shifters at both levels. This is shown pictorially in FIG. 10, and it will be appreciated that this techniques may be applied to all of the embodiments disclosed herein.

Figure 10:
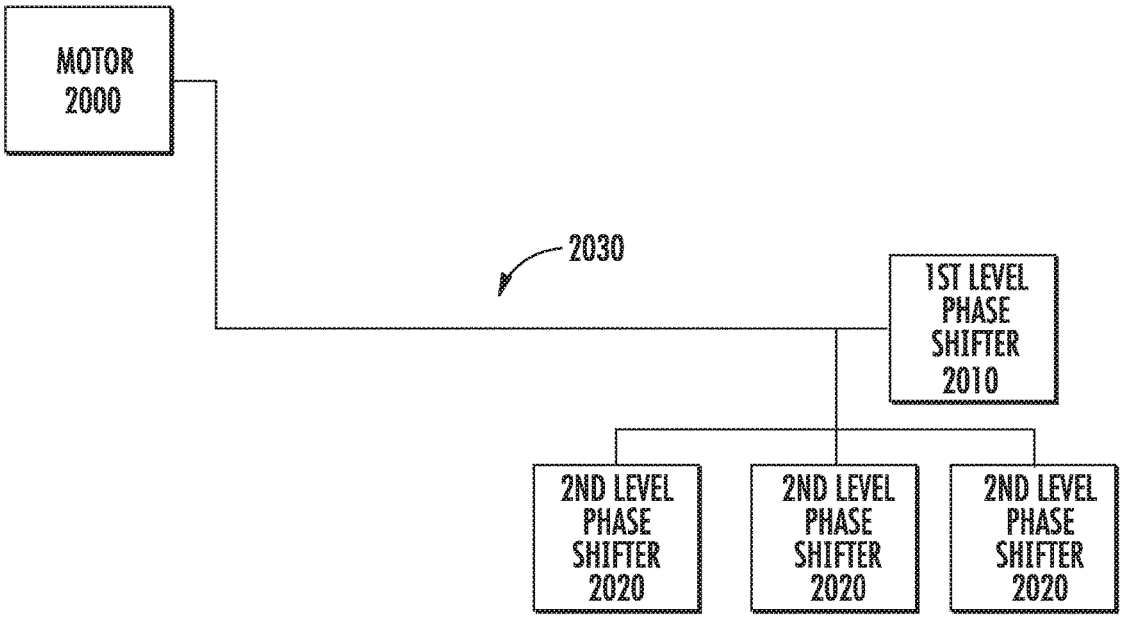
FIG. 10 is a schematic block diagram illustrating how a single mechanical linkage may be used to adjust wiper arms on both first level and second level phase shifters of phased array antennas according to embodiments of the present invention.

As shown in FIG. 10, an antenna may include a motor 2000, a first level phase shifter 2010 and a plurality of second level phase shifters 2020. The motor 2000 may, for example, be configured to generate linear movement. A mechanical linkage 2030 may be provided that transfers this linear movement to the wiper arms of both the first level phase shifter 2010 and the second level phase shifters 2020.

Figure 11A:
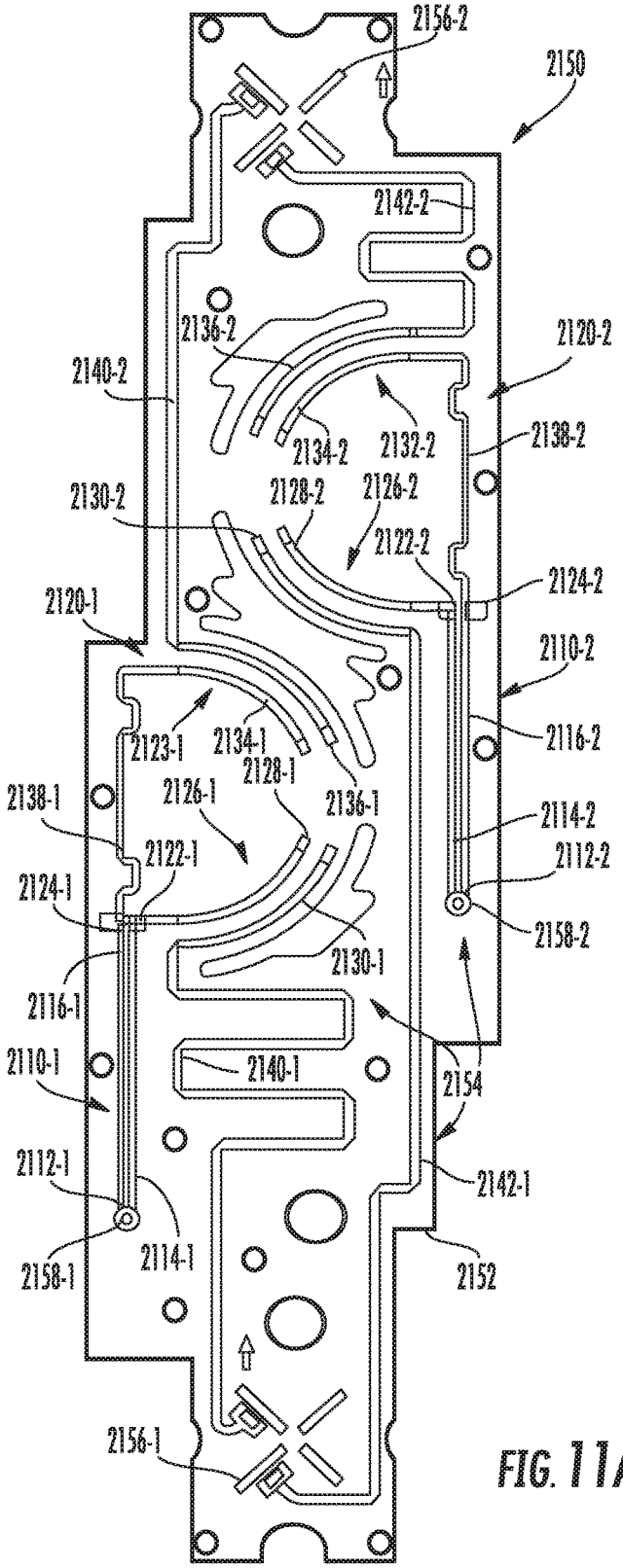
FIGS. 11A-11E are various views illustrating a design of a low-band feed board according to embodiments of the present invention that includes mounting locations for two low-band radiating elements and a pair of 1×2 feed board adjustable phase shifters.
Figure 11B:
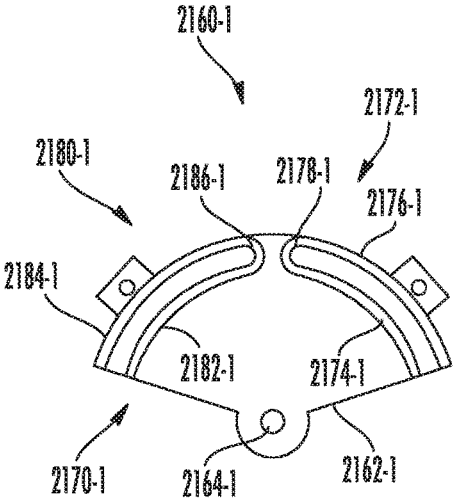
Figure 11C:
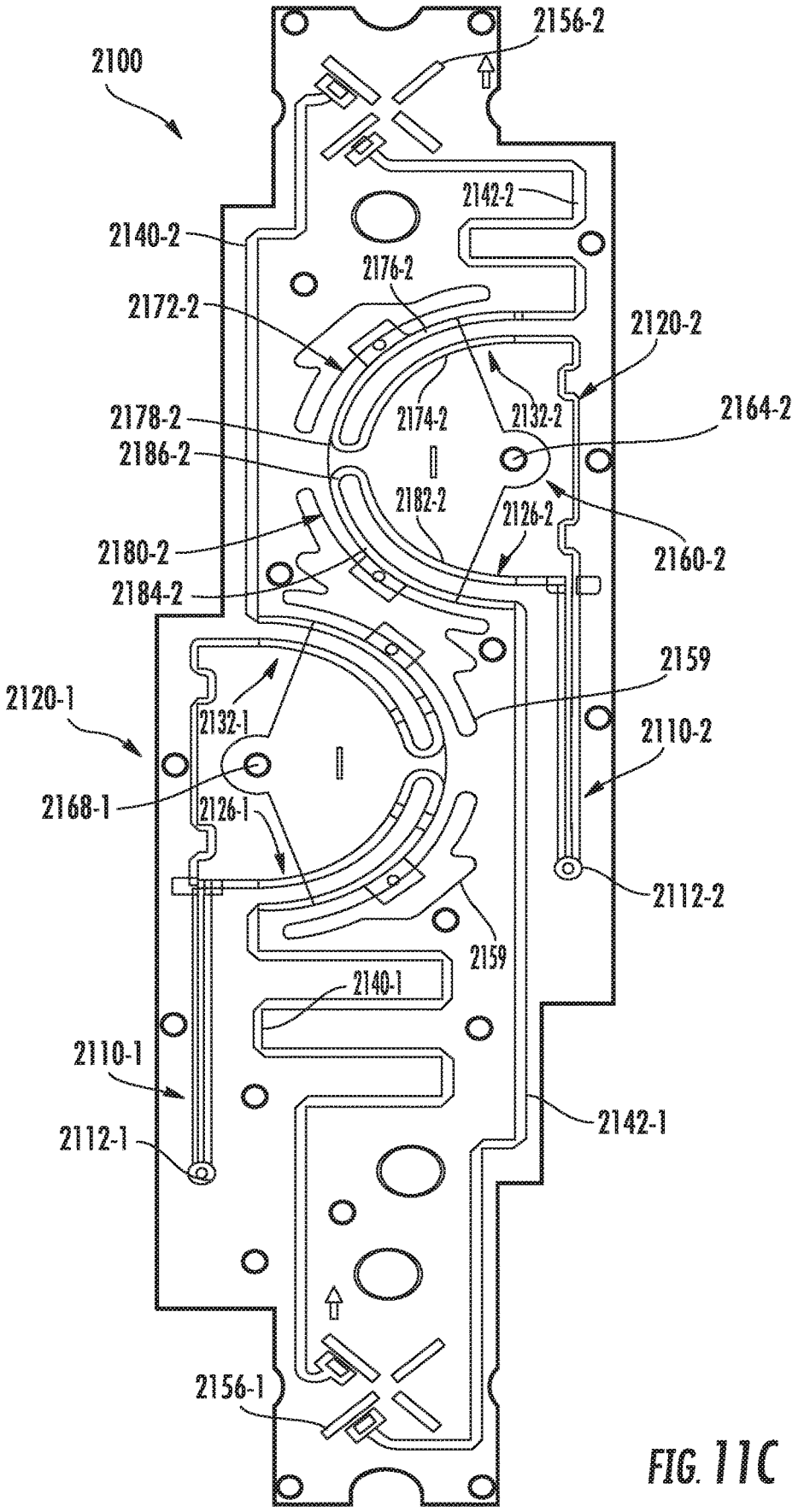
Figure 11D:
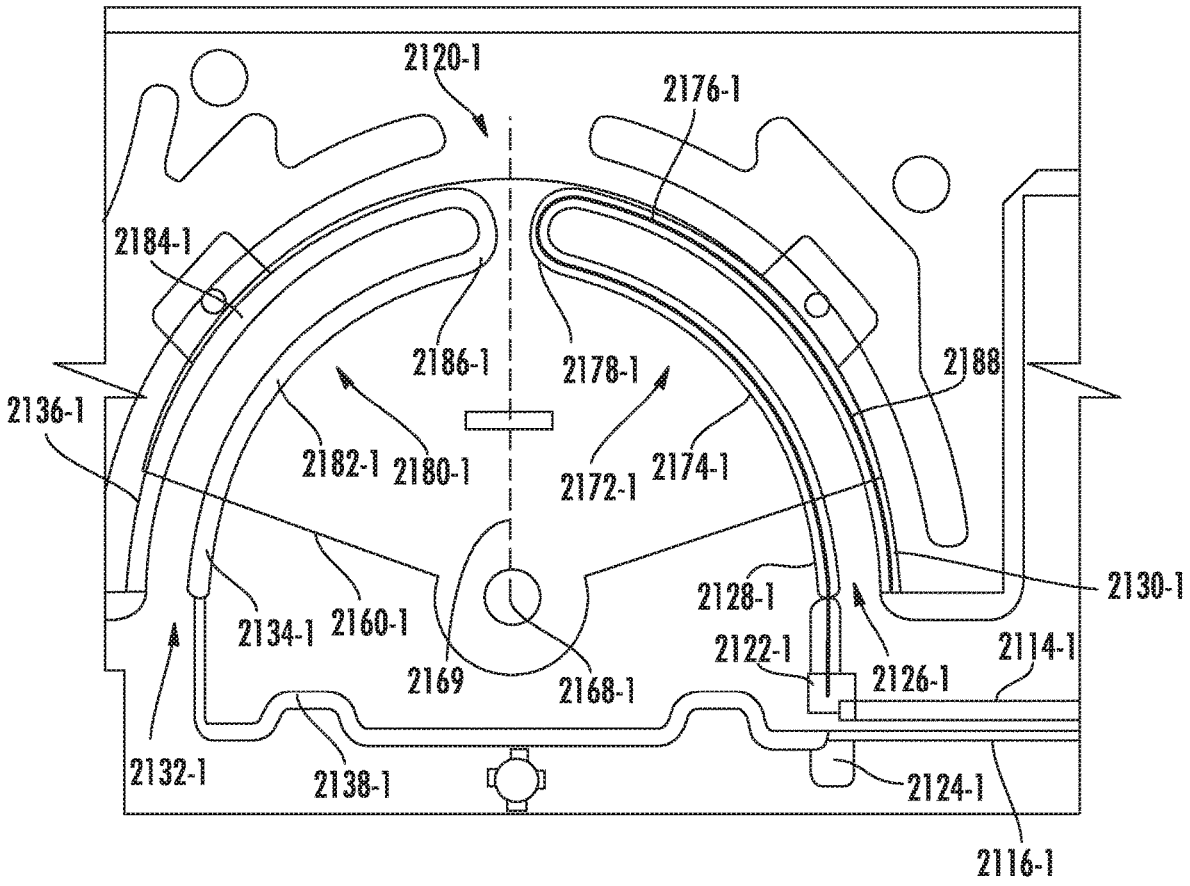
Figure 11E:
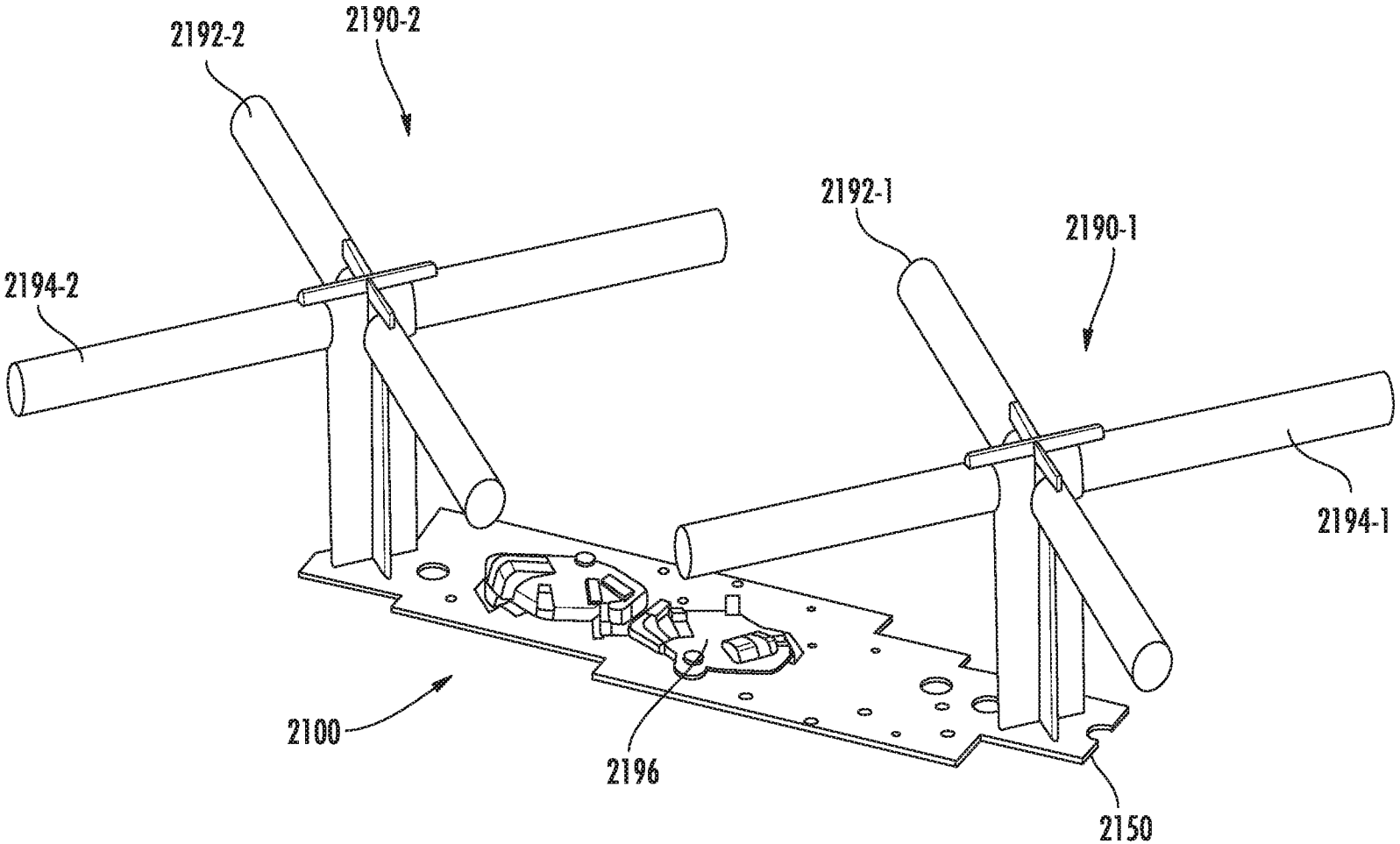

FIGS. 11A-11E illustrate an example implementation of a low-band feed board 2100 according to embodiments of the present invention. In particular, FIG. 11A is a plan view of the main feed board 2150 of feed board 2100. FIG. 11B is a plan view of a wiper board 2160-1 of feed board 2100. The wiper board 2160-1 and an identical wiper board 2160-2 are mounted on the main feed board 2150. FIG. 11C is a plan view of the main feed board 2151 with both wiper boards 2160 mounted thereon. FIG. 11D is an enlarged view of a portion of FIG. 11C that illustrates the path that a first sub-component of an RF signal traverses within one of the phase shifters 2120-1 that is included in low-band feed board 2100. Finally, FIG. 11E is a schematic perspective view of the feed board 2100 with two low-band radiating elements 2190-1, 2190-2 mounted thereon.

The low-band feed board 2100 includes first and second power dividers 2110-1, 2110-2, first and second phase shifters 2120-1, 2120-2, first delay lines 2140-1, 2140-2, and second delay lines 2142-1, 2142-2. The low-band feed board 2100 includes the main feed board 2150 and a pair of wiper boards 2160-1, 2160-2, as will be discussed below.

FIG. 11A is a plan view of the main feed board 2150. As shown in FIG. 11A, the main feed board 2150 is a microstrip printed circuit board that includes a dielectric substrate 2152 with conductive traces 2154 formed on an upper side thereof and a conductive ground plane (not visible in the drawings) formed on the lower side thereof. The main feed board 2150 also includes a pair of cross-shaped slit patterns 2156-1, 2156-2 and a pair of input ports 2158-1, 2158-2. Each input port 2158-1, 2158-2 may be connected to an output of a base-level adjustable phase shifter (not shown) via, for example, respective coaxial cables (not shown). The conductive traces 2154 include conductive traces 2112, 2114, 2116 that form the power dividers 2110, conductive traces 2126, 2128, 2134, 2136, 2138 that form a portion of each phase shifter 2120, and conductive traces that form the delay lines 2140, 2142. The main feed board 2150 may be implemented as a stripline board in other embodiments.

As can be seen in FIG. 11A, power dividers 2110-1 and 2110-2 may each be implemented as a Wilkinson power divider. While Wilkinson power dividers are shown in the example embodiment of FIGS. 11A-11E, it will be appreciated that in other embodiments other types of power dividers may be used such as, for example, T-junction splitter power dividers.

Each power divider 2110 includes an input 2112 and first and second outputs 2114, 2116. The input 2112-1 of power divider 2110-1 is coupled to input port 2158-1, and the input 2112-2 of power divider 2110-2 is coupled to input port 2158-2. Each power divider 2110 may be designed to evenly or unevenly split the power that is received at its respective input port 2112. The first output 2114-1 of power divider 2110-1 is connected to a first input 2122-1 of the first phase shifter 2120-1, and the second output 2116-1 of power divider 2110-1 is connected to a second input 2124-1 of the first phase shifter 2120-1.

Phase shifter 2120-1 includes the first and second inputs 2122-1, 2124-1, a first pair of concentrically arranged arcuate traces 2126-1 that includes an inner trace 2128-1 and an outer trace 2130-1, a second pair of concentrically arranged arcuate traces 2132-1 that includes an inner trace 2134-1 and an outer trace 2136-1, and a connecting trace 2138-1. The first input 2122-1 is located at a first end of the inner trace 2128-1 of the first pair of concentrically arranged arcuate traces 2126-1. The second input 2124-1 is located at one end of connecting trace 2138-1. The second end of connecting trace 2138-1 connects to the first end of inner trace 2134-1 of the second pair of concentrically arranged arcuate traces 2132-1. The first ends of the outer traces 2130-1, 2136-1 of the first and second pairs of concentrically arranged arcuate traces 2126-1, 2132-1 are connected to the respective delay lines 2140-1, 2140-2. The second ends of the inner traces 2128-1, 2134-1 and the second ends of the outer traces 2128-1, 2134-1 are open-circuited. The first and second pairs of concentrically arranged arcuate traces 2126-1, 2132-1 are formed on the main feed board 2150.

Referring now to FIG. 11B, the design of the first wiper board 2160-1 is shown. As noted above, the first wiper board

2160-1, as well as an identical second wiper board 2160-2, are mounted on the main feed board 2150. The wiper board 2160-1 may comprise a microstrip printed circuit board that includes a dielectric substrate 2162-1 with conductive traces 2170-1 formed on an upper side thereof and a conductive ground plane (not visible in the drawings) formed on the lower side thereof. The wiper board 2160-1 may be implemented as a stripline board in other embodiments. The wiper board 2160-1 may be wedge-shaped, and a pivot pin hole 2164-1 is formed through the microstrip printed circuit board near the apex thereof. The conductive traces 2170-1 comprise a first arcuate U-shaped trace 2172-1 that includes an inner arm 2174-1, an outer arm 2176-1 and a connecting portion 2178-1, and a second arcuate U-shaped trace 2180-1 that includes an inner arm 2182-1, an outer arm 2184-1 and a connecting portion 2186-1. The inner and outer arms 2174-1, 2176-1 of the first arcuate U-shaped trace 2172-1 may be designed to overlap the respective inner and outer traces 2128-1, 2130-1 of the first pair of concentrically arranged arcuate traces 2126-1, and the inner and outer arms 2182-1, 2184-1 of the second arcuate U-shaped trace 2180-1 may be designed to overlap the respective inner and outer traces 2134-1, 2136-1 of the second pair of concentrically arranged arcuate traces 2132-1. The phase shifter 2120-1 may be used to adjust the relative phases of the two sub-components of an RF signal that are output from power divider 2110-1, as will be explained in further detail below.

Operation of the phase shifter 2120-1 will now be discussed with reference to FIGS. 11A-11D. An RF signal is input to the power divider 2110-1 and is split into two sub-components that are output on the respective outputs 2114-1, 2116-1 of the power divider 2110-1. A first of these outputs 2114-1 is coupled to the first pair of concentrically arranged arcuate traces 2126-1 of the first phase shifter 2120-1 and the second of these outputs 2116-1 is coupled to the second pair of concentrically arranged arcuate traces 2132-1 of the first phase shifter 2120-1. As shown in FIG. 11C, the wiper board 2160-1 is mounted on the main feed board 2150 above the first and second pairs of concentrically arranged arcuate traces 2126-1, 2132-1 that are part of the first phase shifter 2120-1. The wiper board 2160-1 is mounted on the main feed board 2150 by a pivot pin 2168-1 so that the wiper board 2160-1 may rotate above the main feed board 2150 in a plane parallel to the plane defined by the main feed board 2150.

The phase of each of the two sub-components of the RF signal that pass through phase shifter 2120-1 will be determined by the path length of the RF transmission lines on the main feed board 2150 and the wiper boards 2160-1 that connect each output 2114-1, 2116-1 of the power divider 2110-1 to a respective one of the radiating elements 2190-1, 2190-2. As can be seen in FIG. 11A, the delay line 2140-1 that is included along the RF transmission path between the first output 2114-1 of power divider 2110-1 and radiating element 2190-1 is longer than the delay line 2140-2 that is included along the RF transmission path between the second output 2116-1 of power divider 2110-1 and radiating element 2190-2. This will result in a phase taper between the sub-component of the RF signal supplied to radiating element 2190-1 and the sub-component of the RF signal supplied to radiating element 2190-2.

The path lengths of the RF transmission lines through the phase shifter 2110-1 for the respective sub-components of the RF signal are a function of the rotary position of the wiper board 2160-1. In particular, the sub-component of the RF signal that is output through output 2114-1 of the power divider 2110-1 passes to inner trace 2128-1 of the first pair of concentrically arranged arcuate traces 2126-1. This sub-component of the RF signal then capacitively couples to the inner arm 2174-1 of the arcuate U-shaped trace 2172-1 on the wiper board 2160-1, where it travels around the connecting portion 2178-1 of the "U" and onto the outer arm 2176-1 of the arcuate U-shaped trace 2172-1. The sub-component of the RF signal capacitively couples from the outer arm 2176-1 of the arcuate U-shaped trace 2172-1 onto the outer trace 2130-1 of the first pair of concentrically arranged arcuate traces 2126-1 and, from there, onto the delay line 2140-1.

Referring now to FIG. 11D, when the central radius 2169 of the wiper board 2160-1 is at the "12:00 position" on the main feed board 2150 (i.e., the central radius 2169 of the wiper board 2160-1 is midway between the open-circuited ends of the first and second pairs of concentrically arranged arcuate traces 2126-1, 2132-1), the distance the first sub-component of the RF signal will travel through the phase shifter 2120-1 is illustrated by the line 2188. The second sub-component of the RF signal will travel the exact same distance through the phase shifter 2120-1 due to the symmetry of the traces on the main feed board 2150 and the wiper board 2160-1. If the wiper board 2160-1 is rotated to the left, it is readily apparent that the distance the first sub-component of the RF signal travels will increase since the arcuate U-shaped trace 2172-1 rotates to the left, which adds additional portions of traces 2128-1 and 2130-1 to the RF transmission path, extending the length thereof. The distance the second sub-component of the RF signal travels decreases since as the arcuate U-shaped trace 2172-1 rotates to the left, additional portions of traces 2134-1 and 2136-1 are covered up by the wiper board 2160-1 and hence removed from the RF transmission path, thereby shortening the RF transmission path. Conversely, if the wiper board 2160-1 is rotated to the right, the distance the first sub-component of the RF signal travels will decrease since rotation of the arcuate U-shaped trace 2172-1 to the right covers up additional portions of traces 2128-1 and 2130-1, thereby decreasing the length of the RF transmission path. The distance the second sub-component of the RF signal travels increases since rotation of the arcuate U-shaped trace 2172-1 to the right adds additional portions of traces 2134-1 and 2136-1 to the RF transmission path. Thus, by rotating the wiper board 2160-1, the path length through the phase shifter 2120-1 for one of the two sub-components of the RF signal is increased while the path length of the RF transmission line through the phase shifter 2120-1 for the other of the two sub-components of the RF signal is decreased. As known to those of skill in the art, a remote electronic tilt actuator may be used to move the wiper board 2160-1. In this fashion, the phase difference between the two sub-components of the RF signal may be set to a range of different values.

Referring now to FIG. 11E, it can be seen that each low-band radiating element 2190-1, 2190-2 comprises a slant +45°/−45° crossed dipole radiating element. The first dipole 2192-1, 2192-2 of each radiating element 2190-1, 2190-2 transmits an RF signal having a +45° polarization, and the second dipole 2194-1, 2194-2 of each radiating element 2190-1, 2190-2 transmits an RF signal having a −45° polarization. As shown in FIGS. 11A and 11C, the delay lines 2140-1, 2140-2 connect the two outputs of the phase shifter 2120-1 to the respective first dipoles 2192-1, 2192-2 of the radiating elements 2190-1, 2190-2. Thus, the power divider 2110-1, the phase shifter 2120-1, and the first delay lines 2140-1, 2140-2 feed the two sub-components of the RF signal input at input port 2158-1 to the first dipoles

2192-1, 2192-2 of radiating elements 2190-1, 2190-2. The power divider 2110-2, the phase shifter 2120-2, and the second delay lines 2142-1, 2142-2 feed the two sub-components of the RF signal input at input port 2158-2 to the second dipoles 2194-1, 2194-2 of radiating elements 2190-1, 2190-2. As operation of these elements is the same as described above with respect to the +45° polarization, further discussion thereof will be omitted.

As is also shown in FIG. 11E, a biasing element 2196 may be mounted on the main feed board 2150 above the first and second wiper boards 2160-1, 2160-2. The biasing element may be mounted in openings 2159 included in the main feed board (see FIG. 11C). The biasing element 2196 may apply a force onto the upper surface of each wiper board 2160 in order to enhance the capacitive coupling between the conductive traces on the main feed board 2150 and the conductive traces on the wiper boards 2160.

While the low-band feed board 2100 of FIGS. 11A-11E uses rotary trombone-style phase shifters 2120, it will be appreciated that other types of phase shifters may be used. For example, in other embodiments, linear trombone-style phase shifters may be used in place of the rotary trombone-style phase shifters used in low-band feed board 2100.

As is readily apparent from the above-description, the low-band feed board 2100 may allow the phase to each of the low-band radiating elements 2190 to be individually adjusted, while only requiring one coaxial cable connection for each polarization to the low-band feed board 2100. This may simplify the manufacture of an antenna that uses low-band feed board 2100, remove possible sources of PIM distortion (namely the additional coaxial cable connections that would be required if each of the two radiating elements were connected to a base-level adjustable phase shifter) while improving the performance of the antenna by allowing independent control of the phase. A further advantage of the compact differential trombone-style phase shifter implementation as compared to a reactive tee wiper arc implementation is that the uneven power split allows for additional control of the amplitude taper and improved elevation pattern sidelobe levels.

Figure 12A:
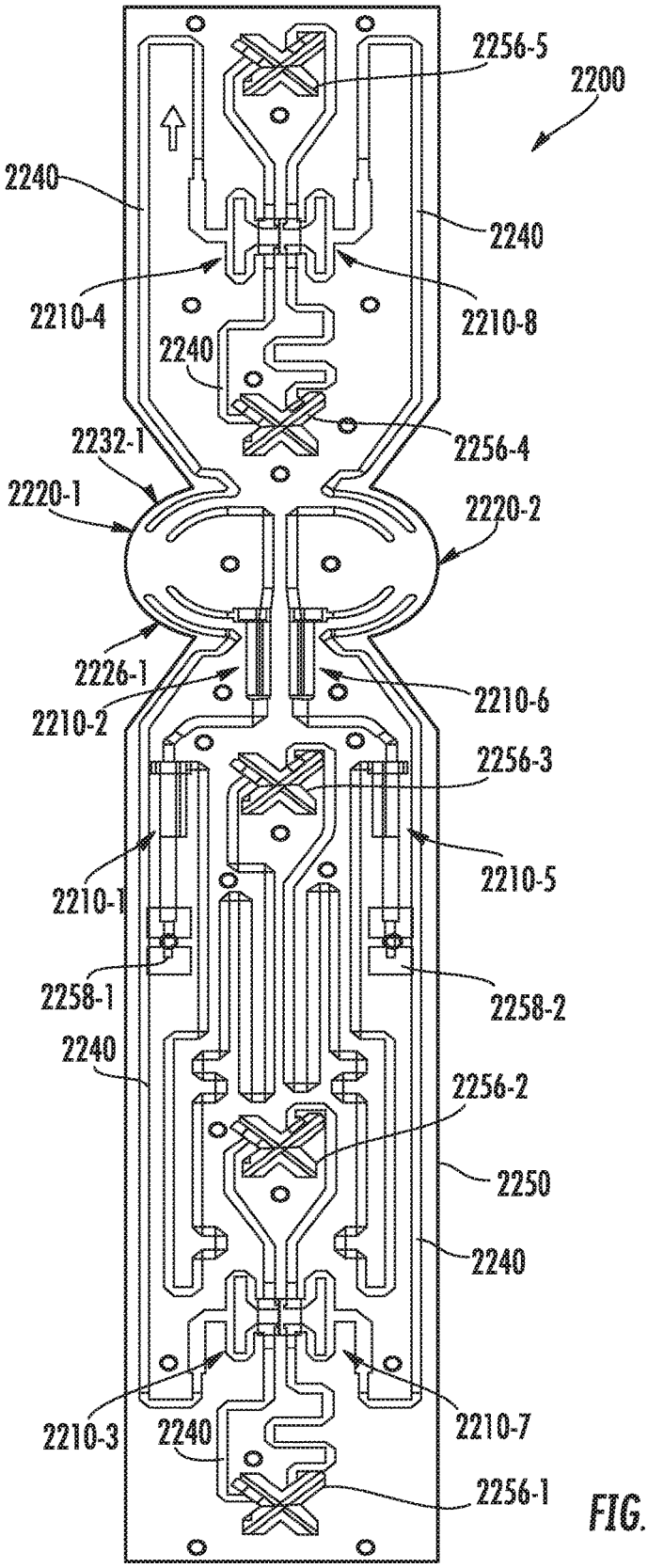
FIGS. 12A-12B are plan views of components of a high-band feed board according to embodiments of the present invention that includes five mounting locations for high band radiating elements and a pair of 1×3 feed board adjustable phase shifters.
Figure 12B:
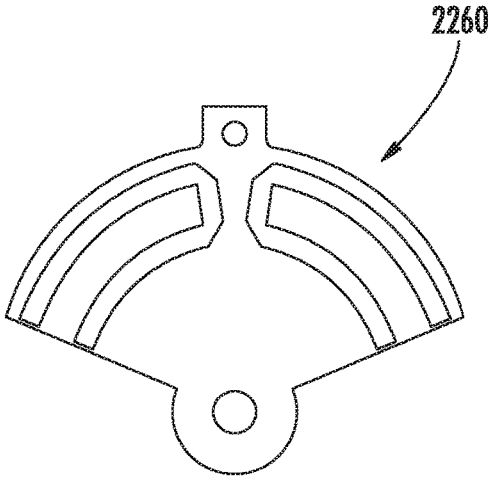

FIGS. 12A-12B are plan views of components of a high-band feed board 2200 that includes five mounting locations for high band radiating elements (not shown) and a pair of 1×3 feed board adjustable phase shifters according to embodiments of the present invention. The high-band feed board 2200 may be used, for example, to implement each of the feed boards 1720-1, 1720-2, 1720-3 of phased array antenna 1700 of FIG. 3C above.

The high-band feed board 2200 includes eight power dividers 2210-1 through 2210-8, first and second phase shifters 2220-1, 2220-2, and a plurality of delay lines 2240. The high-band feed board 2200 includes a main feed board 2250 and a pair of wiper boards 2260. The wiper boards 2260 are not shown in FIG. 12A, but one of the wiper boards is depicted in FIG. 12B. The wiper boards 2260 are mounted above the phase shifter portions of the main feed board 2250 in the same exact manner that the wiper boards 2160 are mounted above the phase shifter portions of the main feed board 2140 of feed board 2100, and hence further description of the mounting of the wiper boards 2260 will be omitted here. Since the design and operation of the high-band feed board 2200 is similar to the design and operation of the low-band feed board 2100 that is discussed above, the following description of the design and operation of the high-band feed board 2200 will focus on differences from the low-band feed board 2100.

Referring to FIG. 12A, the main feed board 2250 is a microstrip printed circuit board that includes five cross-shaped slit patterns 2256-1 through 2156-5 and a pair of input ports 2258-1, 2258-2. Eight power dividers 2210-1 through 2110-8 are formed on the main feed board 2200 and may each be implemented as, for example, a Wilkinson power divider. Each power divider 2210 may be designed to evenly or unevenly split the power that is received at its input port.

Power divider 2210-1 includes an input that is connected to the first input port 2258-1, a first output that is connected to the mounting location 2256-3 for the third radiating element via a delay line 2240, and a second output. As the first output of power divider 2210-1 is connected by conductive traces directly to the mounting location 2256-3 for the third radiating element, the phase delay of the sub-component of an RF signal input at input port 2258-1 that is provided to the third radiating element will be fixed (i.e., not adjustable). The second output of power divider 2210-1 is connected to an input of the second power divider 2210-2. The first output of power divider 2210-2 is connected to a first input of the first phase shifter 2220-1, and the second output of power divider 2210-2 is connected to a second input of the first phase shifter 2220-1.

Phase shifter 2220-1 has the same design as the phase shifter 2120-1 discussed above, and hence the design and operation of phase shifter 2220-1 will not be repeated here. Phase shifter 2220-1 includes the first and second pairs of concentrically arranged arcuate traces 2226-1, 2232-1. Phase shifter 2220-1 includes first and second outputs that are located at the ends of the outer traces of the respective first and second pairs of concentrically arranged arcuate traces 2226-1, 2232-1.

The first output of phase shifter 2220-1 is connected to the third power divider 2210-3 via a delay line 2240, and the second output of phase shifter 2220-1 is connected to the fourth power divider 2210-4 via a delay line 2240. The first output of the third power divider 2210-3 is connected to the mounting location 2256-1 for the first radiating element via a delay line 2240, and the second output of the third power divider 2210-3 is connected to the mounting location 2256-2 for the second radiating element via another delay line 2240. The first output of the fourth power divider 2210-4 is connected to the mounting location 2256-4 for the fourth radiating element via another delay line 2240, and the second output of the fourth power divider 2210-4 is connected to the mounting location 2256-5 for the fifth radiating element via yet another delay line 2240.

Thus, an RF signal that is input at input port 2258-1 is split (either equally or unequally) by the first power divider 2210-1 into two sub-components, and the first sub-component is fed to the third radiating element with a fixed phase shift. The second sub-component of the RF signal is split into third and fourth sub-components, which are phase shifted different amounts by the phase shifter 2220-1. The phase-shifted third sub-component of the RF signal is fed to the third power divider 2210-3 where it is split (either equally or unequally) into fifth and sixth sub-components which are fed to the respective first and second radiating elements. The phase-shifted fourth sub-component of the RF signal is fed to the fourth power divider 2210-4 where it is split (either equally or unequally) into seventh and eighth sub-components that are fed to the respective fourth and fifth radiating elements. Thus, the feed board 2200 may provide a fixed phase shift to the third radiating element, a first variable phase shift to the signals fed to the first and second radiating elements, and a second variable phase shift to the signals fed to the fourth and fifth radiating elements. Additionally, a first fixed phase shift may also be implemented in the delay lines 2240 between the signals fed to the first and second radiating elements and a second fixed phase shift may be implemented in the delay lines 2240 between the signals fed to the fourth and fifth radiating elements.

It will also be appreciated that each potential modification to the feed board 2100 that is discussed above could also be applied to the feed board 2200.

Figure 13A:
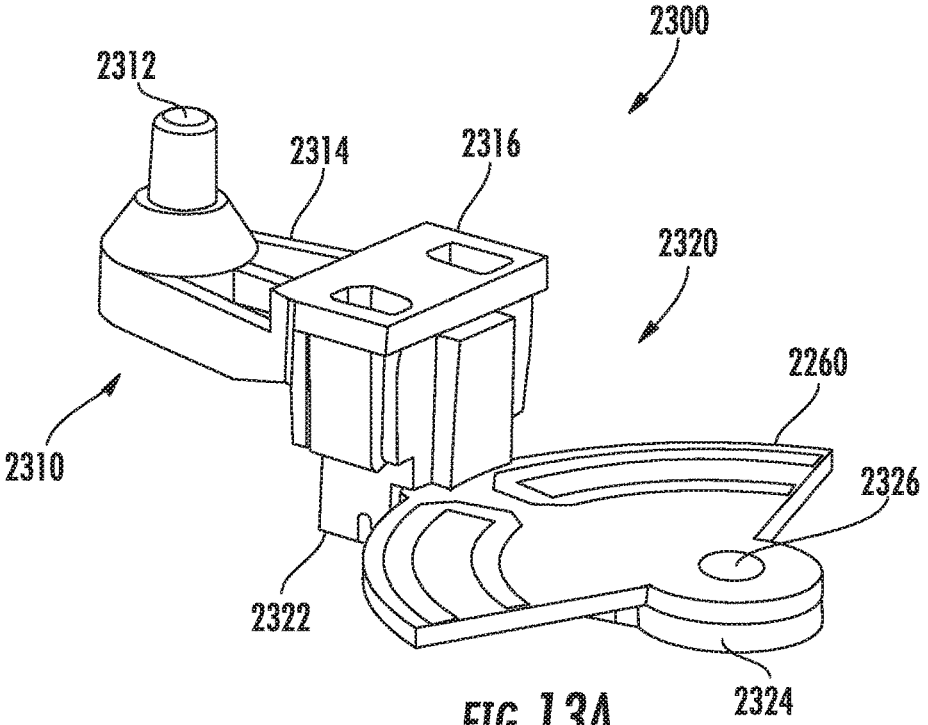
FIG. 13A is a perspective view of a support that connects the wiper board of FIG. 12B to a remote electronic downtilt mechanical linkage.
Figure 13B:
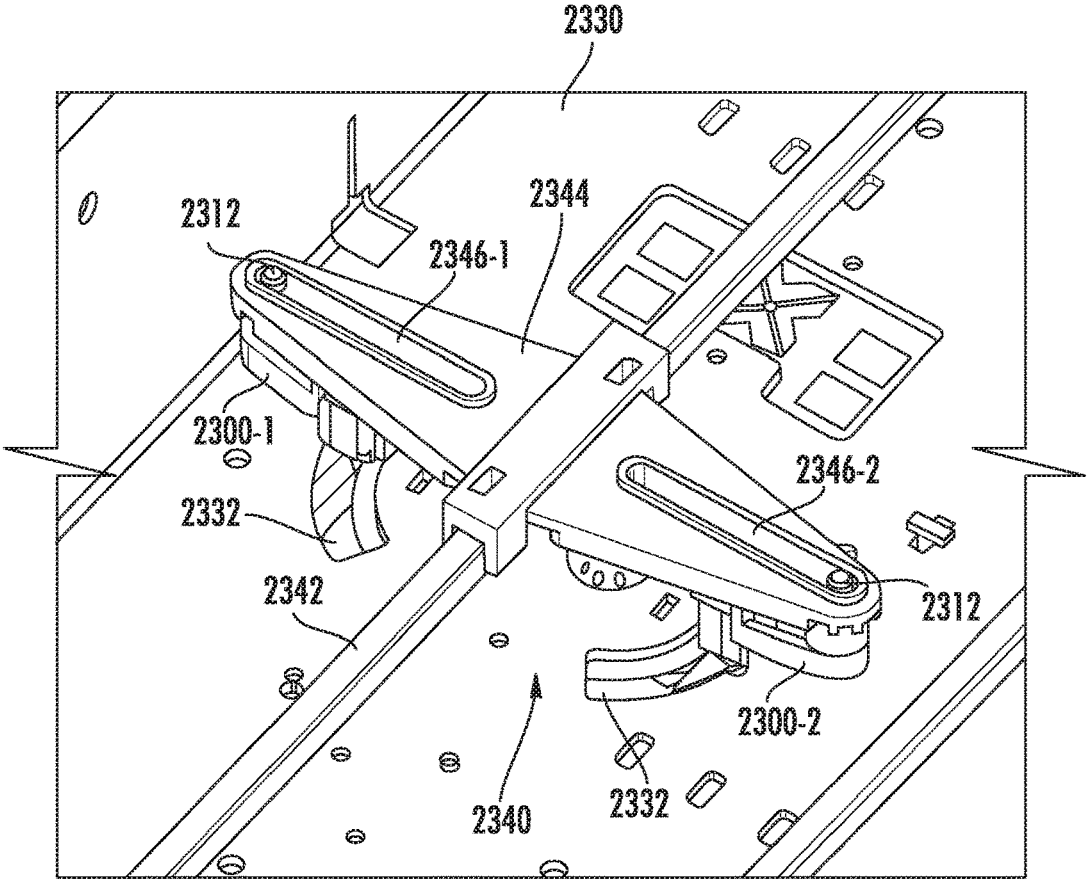
FIG. 13B is a perspective view illustrating how the support of FIG. 13A connects to the remote electronic downtilt mechanical linkage.

FIG. 13A is a perspective view of a support 2300 that may be used to connect one of the wiper boards of feed board 2200 to a remote electronic downtilt mechanical linkage. FIG. 13B is a perspective view illustrating how the support 2300 connects to the remote electronic downtilt mechanical linkage.

As shown in FIGS. 13A and 13B, the support 2300 comprises a two-piece support having a lower piece 2310 and an upper piece 2320. The lower and upper pieces 2310, 2320 may be clipped together. The lower piece 2310 includes a post 2312, a connecting section 2314 and a clip 2316. The lower piece 2310 may be on the underside of a reflector 2330 of the base station antenna. The upper piece 2320 may include a clip 2322 and a wiper board support 2324. A wiper board 2260 may be mounted on the wiper board support 2324. A pin 2326 may be inserted through an aperture in the wiper board support 2324 and the wiper board 2260 and fixed into the main feed board 2250 (not visible in FIG. 13B). The pin 2326 may mount the wiper board support 2324 (and hence the wiper board 2260) for rotary movement above the main feed board 2250. The upper piece 2320 may be on the front side of the reflector 2330 of the base station antenna. The radiating elements of the base station antenna (not shown) may extend outwardly from the front side of the reflector 2330. A separate support 2300 is provided for each wiper board, so two of the supports 2300 will be used in feed board 2200, as shown in FIG. 13B.

The reflector 2330 includes a pair of slots 2332. The lower and upper pieces 2310, 2320 of each support 2300 are clipped together through a respective one of the slots 2332 so that the lower piece 2310 is on the underside of the reflector 2330 and the upper piece 2320 is on the front side of the reflector. As is further shown in FIG. 13B, a remote electronic downtilt mechanical linkage 2340 may be provided on the underside of the reflector 2330. The remote electronic downtilt mechanical linkage 2340 may include an arm 2342 and a slotted drive member 2344 that includes first and second slots 2346-1, 2346-2.

When the arm 2342 of the remote electronic downtilt mechanical linkage 2340 is, for example, pulled to the lower left in FIG. 13B, the slotted drive member 2344 is pulled with it. When this occurs, the post 2312 of each support 2300 moves to the left in FIG. 13B and the posts 2312 also move inwardly in their respective slots 2346 of the slotted drive member 2344. As the post 2312 moves in this fashion, the wiper board support 2324 rotates about the pin 2326 to set the phase shifters 2220-1, 2220-2 to desired positions. Use of the supports 2300 and slotted drive member 2344 allows the remote electronic downtilt mechanical linkage 2340 to be located on the underside of the reflector 2330 as opposed to the front side. This can reduce cost and increase the available aperture real estate.

It will be appreciated that numerous modifications may be made to the above disclosed example embodiments. For example, the number of radiating elements may be changed from what is shown in the example embodiments herein. Typically, the number of radiating elements for a phased array will be selected based on a number of factors including a desired coverage pattern, the frequency band, etc. It will be appreciated that the multi-level phase shifter approach disclosed herein may be used with arrays having any number of radiating elements. It will likewise be appreciated that the number of radiating elements per feed board and the number of radiating elements per phase shifter output may also be varied. As yet another example, while embodiments of the present invention are discussed in terms of flat panel antennas, it will be appreciated that they are equally applicable to antennas that have curved or other non-planar profiles. Thus, it will be appreciated that the embodiments disclosed herein are merely provided as examples to ensure that the concepts of the present invention are fully disclosed to those of skill in the art.

It will also be appreciated that the multi-level phase shifter concept may be used on planar arrays (e.g., arrays of radiating elements that have multiple columns as well as multiple rows of radiating elements). In fact, as the radiating elements in such planar arrays may be subdivided into groups that are closer together, the use of multi-level phase shifters may be particularly useful in such antenna designs as the transmission lines may be shorter in such planar arrays.

The use of multiple levels of phase shifters is non-intuitive, as it would seem to increase the size, weight, cost and complexity of the antenna with no apparent improvement in performance and with an apparent decrease in reliability due to the expanded number of parts that are potentially subject to failure. In particular, each added phase shifter comprises another device that takes up room, requires power connections, adds insertion losses and is subject to failure. However, the present inventors appreciated that the change in performance and/or weight may be relatively minor, as smaller phase shifters may be used in the multi-level phase shifter approach, and because these smaller phase shifters may have lower insertion losses than phase shifters having a larger number of outputs. Moreover, by significantly reducing the number of solder joints the manufacturing and testing of the antenna may be simplified, the reliability of the antenna may be improved, and the potential source for PIM distortion may be significantly reduced.

It will likewise be appreciated that more than two levels of phase shifters could be used in other embodiments.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

All embodiments can be combined in any way and/or combination.

That which is claimed is:

1. A phased array antenna, comprising:

a panel;

a plurality of feed boards on the panel, each of the feed boards including at least one radiating element;

a base-level adjustable phase shifter including a plurality of outputs;

a first feed board adjustable phase shifter mounted on a first of the feed boards that includes a plurality of radiating elements mounted thereon, wherein the first feed board adjustable phase shifter is coupled to the plurality of radiating elements mounted on the first of the feed boards; and a first cable that forms a transmission path between a first of the outputs of the base-level adjustable phase shifter and the first feed board.

2. The phased array antenna of claim 1, further comprising a second feed board adjustable phase shifter mounted on a second of the feed boards and a second cable that forms a transmission path between a second of the outputs of the base-level adjustable phase shifter and the second feed board.

3. The phased array antenna of claim 2, wherein the base-level adjustable phase shifter is mounted on a third of the feed boards, and wherein the third of the feed boards includes a third feed board adjustable phase shifter and a plurality of additional radiating elements.

4. The phased array antenna of claim 1, wherein a first end of the first cable is coupled to the first of the output of the base-level adjustable phase shifter via a first radio frequency (RF) junction and a second end of the first cable is coupled to an input of the first feed board adjustable phase shifter via a second RF junction.

5. The phased array antenna of claim 1, wherein the first feed board adjustable phase shifter has a plurality of outputs, and wherein each output of the first feed board adjustable phase shifter is coupled to a respective at least one of the radiating elements on the first of the feed boards.

6. The phased array antenna of claim 5, wherein the first feed board adjustable phase shifter has three outputs, and each output of the first feed board adjustable phase shifter is coupled to a single respective one of the radiating elements.

7. The phased array antenna of claim 5, wherein the first feed board adjustable phase shifter has three outputs, and at least one of the outputs of the first feed board adjustable phase shifter is coupled to at least two of the radiating elements.

8. The phased array antenna of claim 1, wherein the first cable is coupled to an input of the first feed board adjustable phase shifter, and wherein respective printed circuit board transmission lines connect each output of the first feed board adjustable phase shifter to a respective at least one of the radiating elements.

9. The phased array antenna of claim 1, wherein the first of the feed boards includes at least one power divider that unequally divides the power of an RF signal that is input to the first of the feed boards from the first cable.

10. The phased array antenna of claim 1, wherein the first feed board adjustable phase shifter includes a main feed board, a wiper board that is mounted above the main feed board, and a biasing element that is mounted on the main feed board, the biasing element configured to apply a force onto an upper surface of the wiper board in order to bias the wiper board toward the main feed board.

11. The phased array antenna of claim 1, wherein the first feed board adjustable phase shifter includes a main feed board, a wiper board that is mounted above the main feed board, and a multi-piece support that includes a first portion that is mounted on a first side of the panel and a second portion that is mounted on a second side of the panel that is opposite the first side, the support extending through a slot in the panel.

12. The phased array antenna of claim 11, wherein the wiper board is mounted on the multi-piece support.

13. The phased array antenna of claim 1, wherein the first of the feed boards includes at least one power divider that unequally divides the power of an RF signal that is input to the first of the feed boards from the first cable.

14. A phased array antenna, comprising:

a first feed board;

a plurality of radiating elements, a first subset of the radiating elements mounted on the first feed board;

a base-level adjustable phase shifter that has an input and a plurality of outputs;

a first feed board adjustable phase shifter mounted on the first feed board, the first feed board adjustable phase shifter having an input that is coupled to a first of the outputs of the base-level adjustable phase shifter, and a plurality of outputs, wherein each output of the first feed board adjustable phase shifter is connected to a respective one or more of the radiating elements in the first subset of the radiating elements.

15. The phased array antenna of claim 14, further comprising a second feed board adjustable phase shifter mounted on a second feed board, the second feed board adjustable phase shifter having an input that is coupled to a second of the outputs of the base-level adjustable phase shifter, and a plurality of outputs, wherein each output of the second feed board adjustable phase shifter is connected to a respective one or more of the radiating elements included in a second subset of the radiating elements that are mounted on the second feed board.

16. The phased array antenna of claim 15, further comprising:

a first cable that is coupled between the first of the outputs of the base-level adjustable phase shifter and the first feed board adjustable phase shifter; and a second cable that is coupled between the second of the outputs of the base-level adjustable phase shifter and the second feed board adjustable phase shifter.

17. The phased array antenna of claim 16, wherein the first feed board includes at least one power divider that unequally divides the power of an RF signal that is input to the first feed board from the first cable.

18. The phased array antenna of claim 15, wherein the base-level adjustable phase shifter is mounted on the first feed board, the phased array antenna further comprising a first cable that is coupled between the second of the outputs of the base-level adjustable phase shifter and the second feed board adjustable phase shifter.

19. The phased array antenna of claim 14, wherein the base-level adjustable phase shifter and the first feed board adjustable phase shifter comprise two of a plurality of adjustable phase shifters of the phased array antenna, and wherein no more than two of the adjustable phase shifters are on the RF transmission path between an input to the phased array antenna and any of the radiating elements.

20. The phased array antenna of claim 14, wherein the first feed board includes at least one power divider that unequally divides the power of an RF signal that is input to the first feed board.

* * * * *